US009456284B2

(12) United States Patent
Morishita et al.

(10) Patent No.: US 9,456,284 B2
(45) Date of Patent: Sep. 27, 2016

(54) DUAL-ELEMENT MEMS MICROPHONE FOR MECHANICAL VIBRATION NOISE CANCELLATION

(71) Applicant: Google Inc., Mountain View, CA (US)

(72) Inventors: Michael Kai Morishita, Belmont, CA (US); Jianchun Dong, Palo Alto, CA (US)

(73) Assignee: Google Inc., Mountain View, CA (US)

( * ) Notice: Subject to any disclaimer, the term of this patent is extended or adjusted under 35 U.S.C. 154(b) by 382 days.

(21) Appl. No.: 14/216,686

(22) Filed: Mar. 17, 2014

(65) Prior Publication Data

US 2016/0165357 A1 Jun. 9, 2016

(51) Int. Cl.

| | |
|---|---|
| ***H04R 1/00*** | (2006.01) |
| ***H04R 19/04*** | (2006.01) |
| ***H04R 3/00*** | (2006.01) |

(52) U.S. Cl.

CPC ..... *H04R 19/04* (2013.01); *H04R 3/005* (2013.01); *H04R 2201/003* (2013.01); *H04R 2307/027* (2013.01); *H04R 2307/204* (2013.01)

(58) Field of Classification Search

CPC ..... H04R 1/08; H04R 9/08; H04R 11/04; H04R 17/02; H04R 21/02; H04R 19/04; H04R 19/005; H04R 1/00; H04R 2205/022; H04R 2201/401; H04R 2201/405

USPC ..... 381/369, 170–182

See application file for complete search history.

(56) References Cited

U.S. PATENT DOCUMENTS

| | | | | |
|---|---|---|---|---|
| 5,363,452 | A * | 11/1994 | Anderson | H04R 19/04 381/170 |
| 7,912,240 | B2 * | 3/2011 | Madaffari | H04R 9/025 381/182 |
| 8,879,767 | B2 * | 11/2014 | Wickstrom | H04R 19/04 381/174 |
| 8,989,422 | B2 * | 3/2015 | Tanaka | H04R 19/005 381/175 |
| 2003/0048920 | A1 | 3/2003 | Van Halteren et al. | |
| 2011/0123043 | A1 | 5/2011 | Felberer et al. | |
| 2013/0108074 | A1 | 5/2013 | Reining | |

FOREIGN PATENT DOCUMENTS

| | | |
|---|---|---|
| WO | 2013071951 | 5/2013 |
| WO | 2013071952 | 5/2013 |

* cited by examiner

*Primary Examiner* — Suhan Ni
(74) *Attorney, Agent, or Firm* — McDonnell Boehnen Hulbert & Berghoff

(57) ABSTRACT

Disclosed are systems, devices, and methods for minimizing mechanical-vibration-induced noise in audio signals. In one aspect, a microphone is disclosed that includes a first backplate, a first diaphragm, a second backplate, and a second diaphragm. The first diaphragm moves relative to the first backplate in response to acoustic pressure waves in an environment and mechanical vibrations of the microphone, thereby causing a first capacitance change between the first diaphragm and the first backplate. The second diaphragm is substantially acoustically isolated from the acoustic pressure waves, and moves relative to the second backplate in response to the mechanical vibrations of the microphone, thereby causing a second capacitance change between the second diaphragm and the second backplate. The microphone further includes or is communicatively coupled to an integrated circuit configured to generate an acoustic signal based on the first capacitance and the second capacitance.

20 Claims, 14 Drawing Sheets

DUAL-ELEMENT MEMS MICROPHONE FOR MECHANICAL VIBRATION NOISE CANCELLATION

BACKGROUND

Unless otherwise indicated herein, the materials described in this section are not prior art to the claims in this application and are not admitted to be prior art by inclusion in this section.

Typical microelectromechanical system (MEMS) microphones include a flexibly-mounted diaphragm and a rigid backplate which together form a variable capacitor. When acoustic pressure waves are incident on the MEMS microphone, the diaphragm moves relative to the backplate, resulting in a change in capacitance of the variable capacitor. This change in capacitance can be converted into an audio signal corresponding to the acoustic pressure wave.

SUMMARY

While in a typical MEMS microphone, it would be desirable for the diaphragm to move relative to the backplate as a result of only the acoustic pressure waves, in reality the diaphragm may additionally move relative to the backplate as a result of mechanical vibrations, as well as the acoustic pressure waves. As a result, the audio signal converted from the change in capacitance may reflect both the mechanical vibrations and the acoustic pressure waves, resulting in undesirable noise in the audio signal.

Disclosed are systems, devices, and methods for minimizing noise in audio signals by enabling cancellation of the mechanical vibrations in the audio signal.

In one aspect, an apparatus is disclosed that may include a microphone and an integrated circuit. The microphone may include a first diaphragm arranged such that the first diaphragm moves, relative to a first backplate, in response to acoustic pressure waves in an environment of the microphone. The first diaphragm may be further arranged such that the first diaphragm also moves, relative to the first backplate, in response to mechanical vibrations of the microphone. Movement of the first diaphragm relative to the first backplate may cause a first capacitance change between the first diaphragm and the first backplate. The microphone may further comprises a second diaphragm that is substantially acoustically isolated from the environment of the microphone such that the second diaphragm does not move substantially, relative to a second backplate, in response to the acoustic pressure waves in the environment. The second diaphragm may move, relative to the second backplate, in response to the mechanical vibrations of the microphone. Movement of the second diaphragm relative to the second backplate may cause a second capacitance change between the second diaphragm and the second backplate. The integrated circuit may be configured to generate an audio signal based on a difference between the first capacitance change and the second capacitance change.

In another aspect, a microphone is disclosed that may include a first diaphragm arranged such that the first diaphragm moves, relative to a first backplate, in response to acoustic pressure waves in an environment of the microphone. The first diaphragm may be further arranged such that the first diaphragm also moves, relative to the first backplate, in response to mechanical vibrations of the microphone. Movement of the first diaphragm relative to the first backplate may cause a first capacitance change between the first diaphragm and the first backplate. The microphone may further comprises a second diaphragm that is substantially acoustically isolated from the environment of the microphone such that the second diaphragm does not move substantially, relative to a second backplate, in response to the acoustic pressure waves in the environment. The second diaphragm may move, relative to the second backplate, in response to the mechanical vibrations of the microphone. Movement of the second diaphragm relative to the second backplate may cause a second capacitance change between the second diaphragm and the second backplate.

In yet another aspect, a method is disclosed that may include determining a first capacitance change between a first diaphragm and a first backplate of a microphone. The first capacitance change may be determined based on movement of the first diaphragm relative to the first backplate. The first diaphragm may move, relative to the first backplate, in response to both acoustic pressure waves in an environment of the microphone and mechanical vibration of the microphone. The method may further include determining a second capacitance change between a second diaphragm and a second backplate of the microphone. The second capacitance change may be determined based on movement of the second diaphragm relative to the second backplate. The second diaphragm may not substantially move, relative to the second backplate, in response to the acoustic pressure waves in the environment of the microphone, but the second diaphragm may move, relative to the second backplate, in response to the mechanical vibration of the microphone. The method may further include generating an audio signal based on a difference between the first capacitance change and the second capacitance change.

In still another aspect, a device is disclosed that may include means for determining a first capacitance change between a first diaphragm in a microphone and a first backplate in the microphone, where the first capacitance change is based on the movement of the first diaphragm relative to the first backplate in response to acoustic pressure waves and mechanical vibrations. The device may further include means for determining a second capacitance change between a second diaphragm in the microphone and a second backplate in the microphone, where the second capacitance change is based on the movement of the second diaphragm relative to the second backplate in response to the mechanical vibrations. The device may still further include means for determining an audio signal based on the first capacitance change and the second capacitance change.

These as well as other aspects, advantages, and alternatives will become apparent to those of ordinary skill in the art by reading the following detailed description, with reference where appropriate to the accompanying drawings.

DETAILED DESCRIPTION

Figure 1A:
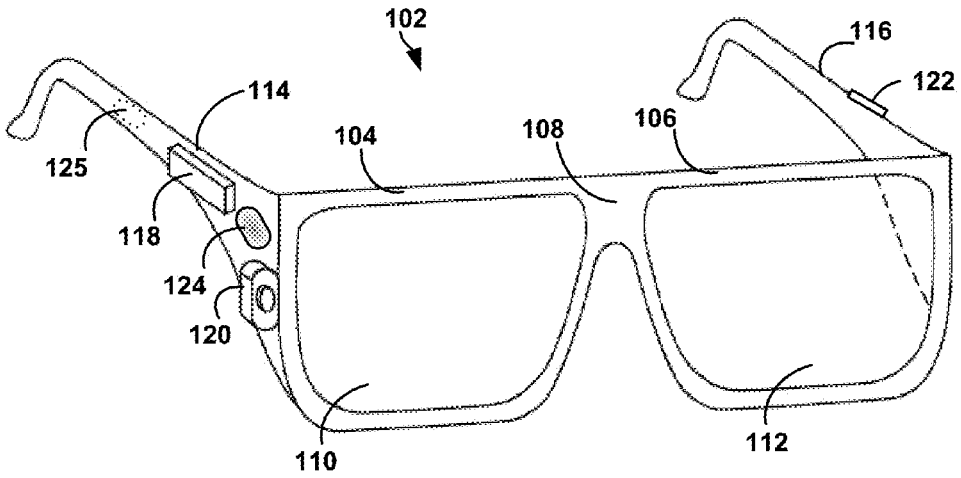
FIG. 1A illustrates a wearable computing system according to an example embodiment.

Example methods and systems are described herein. It should be understood that the words "example," "exemplary," and "illustrative" are used herein to mean "serving as an example, instance, or illustration." Any embodiment or feature described herein as being an "example," being "exemplary," or being "illustrative" is not necessarily to be construed as preferred or advantageous over other embodiments or features. The example embodiments described herein are not meant to be limiting. It will be readily understood that the aspects of the present disclosure, as generally described herein, and illustrated in the figures, can be arranged, substituted, combined, separated, and designed in a wide variety of different configurations, all of which are explicitly contemplated herein.

I. OVERVIEW

As noted above, a typical microelectromechanical system (MEMS) microphone may include a flexibly-mounted diaphragm and a rigid backplate, which together form a variable capacitor. When acoustic pressure waves are incident on the microphone, the diaphragm may move (e.g., vibrate) relative to the backplate. When the diaphragm vibrates, a capacitance between the diaphragm and the backplate changes. The variation in capacitance over time can be converted into an audio signal corresponding to the acoustic pressure waves (e.g., an audio signal that mimics the acoustic pressure waves). In particular, an audio signal may be generated that sounds substantially the same as the acoustic pressure wave.

While it would be desirable in the typical microphone for the diaphragm to move relative to the backplate only in response to the acoustic pressure waves, in reality the diaphragm will move relative to the backplate in response to mechanical vibrations as well. As a result, the audio signal converted from the change in capacitance may reflect both the mechanical vibrations and the acoustic pressure waves, resulting in undesirable mechanical-vibration-induced noise in the audio signal.

Disclosed is a microphone that minimizes mechanical-vibration-induced noise in an audio signal by enabling the cancellation of mechanical vibrations in the audio signal. To this end, the microphone may include a first backplate, a first diaphragm, a second backplate, and a second diaphragm.

The first diaphragm may be exposed to an environment that includes acoustic pressure waves. Accordingly, the first diaphragm may move relative to the first backplate in response to the acoustic pressure waves. However, the first diaphragm may also move relative to the first backplate in response to mechanical vibrations of the microphone. A first capacitance change between the first diaphragm and the first backplate may thus be based on both the acoustic pressure waves and the mechanical vibrations. Put another way, the first capacitance change will include both an acoustic capacitance change and a mechanical capacitance change.

The second diaphragm may be substantially acoustically isolated from the environment, such that the second diaphragm does not substantially move relative to the second backplate in response to the acoustic pressure waves, but the second diaphragm may move relative to the second backplate in response to the mechanical vibrations of the microphone. Thus, a second capacitance change between the second diaphragm and the second backplate may be based on the mechanical vibrations (and substantially not on the acoustic pressure waves). Put another way, the second capacitance change will include substantially only a mechanical capacitance change.

The microphone may further include an integrated circuit configured to determine an acoustic signal for the microphone based on the first capacitance change and the second capacitance change. Because each of the first capacitance change and the second capacitance change include the mechanical capacitance change, the mechanical capacitance change can be cancelled out, leaving substantially only the acoustic capacitance change of the first capacitance change. The audio signal may be determined based on the acoustic capacitance change. In this manner, the disclosed microphone may minimize noise in the audio signal resulting from the mechanical vibrations.

The disclosed microphones may have any number of applications and may be included in any number of devices. For purposes of illustration, the disclosed microphones are described below in connection with a number of wearable computing devices into which the microphones may be integrated or with which the microphones may be implemented. It will be understood, however, that the disclosed microphones could be integrated and/or implemented with other devices as well. For example, the disclosed microphones may be used in connection with other consumer electronic devices. In particular, the disclosed microphones may be used in consumer electronic devices that also include speakers, which may be prone to echo challenges that result from speaker vibrations coupling to the microphone. As another example, the disclosed microphones may be used in devices designed for high-vibration environments, such as devices for use with moving vehicles or machinery and/or devices for use by an active user. Other examples are possible as well.

Example wearable computing devices, example microphones, and example methods for use with the wearable computing devices and/or microphones are described below.

II. EXAMPLE WEARABLE COMPUTING DEVICES

Computing devices such as personal computers, laptop computers, tablet computers, cellular phones, and countless types of Internet-capable devices are increasingly prevalent in numerous aspects of modern life. Over time, the manner in which these devices are providing information to users is becoming more intelligent, more efficient, more intuitive, and/or less obtrusive.

The trend toward miniaturization of computing hardware, peripherals, as well as of sensors, detectors, and image and audio processors, among other technologies, has helped open up a field sometimes referred to as "wearable computing." In the area of image and visual processing and production, in particular, it has become possible to consider wearable displays that place a graphic display close enough to a wearer's (or user's) eye(s) such that the displayed image appears as a normal-sized image, such as might be displayed on a traditional image display device. The relevant technology may be referred to as "near-eye displays."

Wearable computing devices with near-eye displays may also be referred to as "head-mountable displays" (HMDs), "head-mounted displays," "head-mounted devices," or "head-mountable devices." A head-mountable display places a graphic display or displays close to one or both eyes of a wearer. To generate the images on a display, a computer processing system may be used. Such displays may occupy a wearer's entire field of view, or only occupy part of wearer's field of view. Further, head-mounted displays may vary in size, taking a smaller form such as a glasses-style display or a larger form such as a helmet, for example.

Emerging and anticipated uses of wearable displays include applications in which users interact in real time with an augmented or virtual reality. Such applications can be mission-critical or safety-critical, such as in a public safety or aviation setting. The applications can also be recreational, such as interactive gaming. Many other applications are also possible.

Systems and devices in which example embodiments may be implemented will now be described in greater detail. In general, an example system may be implemented in or may take the form of a wearable computer (also referred to as a wearable computing device). In an example embodiment, a wearable computer takes the form of or includes a head-mountable device (HMD).

An example system may also be implemented in or take the form of other devices, such as a mobile phone, among other possibilities. Further, an example system may take the form of non-transitory computer readable medium, which has program instructions stored thereon that are executable by at a processor to provide the functionality described herein. An example system may also take the form of a device such as a wearable computer or mobile phone, or a subsystem of such a device, which includes such a non-transitory computer readable medium having such program instructions stored thereon.

An HMD may generally be any display device that is capable of being worn on the head and places a display in front of one or both eyes of the wearer. An HMD may take various forms such as a helmet or eyeglasses. As such, references to "eyeglasses" or a "glasses-style" HMD should be understood to refer to an HMD that has a glasses-like frame so that it can be worn on the head. Further, example embodiments may be implemented by or in association with an HMD with a single display or with two displays, which may be referred to as a "monocular" HMD or a "binocular" HMD, respectively.

FIG. 1A illustrates a wearable computing system according to an example embodiment. In FIG. 1A, the wearable computing system takes the form of a head-mountable device (HMD) 102 (which may also be referred to as a head-mounted display). It should be understood, however, that example systems and devices may take the form of or be implemented within or in association with other types of devices, without departing from the scope of the invention. As illustrated in FIG. 1A, the HMD 102 includes frame elements including lens-frames 104, 106 and a center frame support 108, lens elements 110, 112, and extending side-arms 114, 116. The center frame support 108 and the extending side-arms 114, 116 are configured to secure the HMD 102 to a user's face via a user's nose and ears, respectively.

Each of the frame elements 104, 106, and 108 and the extending side-arms 114, 116 may be formed of a solid structure of plastic and/or metal, or may be formed of a hollow structure of similar material so as to allow wiring and component interconnects to be internally routed through the HMD 102. Other materials may be possible as well.

One or more of each of the lens elements 110, 112 may be formed of any material that can suitably display a projected image or graphic. Each of the lens elements 110, 112 may also be sufficiently transparent to allow a user to see through the lens element. Combining these two features of the lens elements may facilitate an augmented reality or heads-up display where the projected image or graphic is superimposed over a real-world view as perceived by the user through the lens elements.

The extending side-arms 114, 116 may each be projections that extend away from the lens-frames 104, 106, respectively, and may be positioned behind a user's ears to secure the HMD 102 to the user. The extending side-arms 114, 116 may further secure the HMD 102 to the user by extending around a rear portion of the user's head. Additionally or alternatively, for example, the HMD 102 may connect to or be affixed within a head-mounted helmet structure. Other configurations for an HMD are also possible.

The HMD 102 may also include an on-board computing system 118, an image capture device 120, a sensor 122, and a finger-operable touch pad 124. The on-board computing system 118 is shown to be positioned on the extending side-arm 114 of the HMD 102; however, the on-board computing system 118 may be provided on other parts of the HMD 102 or may be positioned remote from the HMD 102 (e.g., the on-board computing system 118 could be wire- or wirelessly-connected to the HMD 102). The on-board computing system 118 may include a processor and memory, for example. The on-board computing system 118 may be configured to receive and analyze data from the image capture device 120 and the finger-operable touch pad 124 (and possibly from other sensory devices, user interfaces, or both) and generate images for output by the lens elements 110 and 112.

The image capture device 120 may be, for example, a camera that is configured to capture still images and/or to capture video. In the illustrated configuration, image capture device 120 is positioned on the extending side-arm 114 of the HMD 102; however, the image capture device 120 may be provided on other parts of the HMD 102. The image capture device 120 may be configured to capture images at various resolutions or at different frame rates. Many image capture devices with a small form-factor, such as the cameras used in mobile phones or webcams, for example, may be incorporated into an example of the HMD 102.

Further, although FIG. 1A illustrates one image capture device 120, more image capture device may be used, and each may be configured to capture the same view, or to capture different views. For example, the image capture device 120 may be forward facing to capture at least a portion of the real-world view perceived by the user. This forward facing image captured by the image capture device 120 may then be used to generate an augmented reality where computer generated images appear to interact with or overlay the real-world view perceived by the user.

The sensor 122 is shown on the extending side-arm 116 of the HMD 102; however, the sensor 122 may be positioned on other parts of the HMD 102. For illustrative purposes, only one sensor 122 is shown. However, in an example embodiment, the HMD 102 may include multiple sensors. For example, an HMD 102 may include sensors 102 such as one or more gyroscopes, one or more accelerometers, one or more magnetometers, one or more light sensors, one or more infrared sensors, and/or one or more microphones, such as those described below in connection with FIGS. 3-5. Other sensing devices may be included in addition or in the alternative to the sensors that are specifically identified herein.

The finger-operable touch pad 124 is shown on the extending side-arm 114 of the HMD 102. However, the finger-operable touch pad 124 may be positioned on other parts of the HMD 102. Also, more than one finger-operable touch pad may be present on the HMD 102. The finger-operable touch pad 124 may be used by a user to input commands. The finger-operable touch pad 124 may sense at least one of a pressure, position and/or a movement of one or more fingers via capacitive sensing, resistance sensing, or a surface acoustic wave process, among other possibilities. The finger-operable touch pad 124 may be capable of sensing movement of one or more fingers simultaneously, in addition to sensing movement in a direction parallel or planar to the pad surface, in a direction normal to the pad surface, or both, and may also be capable of sensing a level of pressure applied to the touch pad surface. In some embodiments, the finger-operable touch pad 124 may be formed of one or more translucent or transparent insulating layers and one or more translucent or transparent conducting layers. Edges of the finger-operable touch pad 124 may be formed to have a raised, indented, or roughened surface, so as to provide tactile feedback to a user when the user's finger reaches the edge, or other area, of the finger-operable touch pad 124. If more than one finger-operable touch pad is present, each finger-operable touch pad may be operated independently, and may provide a different function.

In a further aspect, HMD 102 may be configured to receive user input in various ways, in addition or in the alternative to user input received via finger-operable touch pad 124. For example, on-board computing system 118 may implement a speech-to-text process and utilize a syntax that maps certain spoken commands to certain actions. In addition, HMD 102 may include one or more microphones via which a wearer's speech may be captured, such as those described below in connection with FIGS. 3-5. Configured as such, HMD 102 may be operable to detect spoken commands and carry out various computing functions that correspond to the spoken commands.

As another example, HMD 102 may interpret certain head-movements as user input. For example, when HMD 102 is worn, HMD 102 may use one or more gyroscopes and/or one or more accelerometers to detect head movement. The HMD 102 may then interpret certain head-movements as being user input, such as nodding, or looking up, down, left, or right. An HMD 102 could also pan or scroll through graphics in a display according to movement. Other types of actions may also be mapped to head movement.

As yet another example, HMD 102 may interpret certain gestures (e.g., by a wearer's hand or hands) as user input. For example, HMD 102 may capture hand movements by analyzing image data from image capture device 120, and initiate actions that are defined as corresponding to certain hand movements.

As a further example, HMD 102 may interpret eye movement as user input. In particular, HMD 102 may include one or more inward-facing image capture devices and/or one or more other inward-facing sensors (not shown) sense a user's eye movements and/or positioning. As such, certain eye movements may be mapped to certain actions. For example, certain actions may be defined as corresponding to movement of the eye in a certain direction, a blink, and/or a wink, among other possibilities.

HMD 102 also includes a speaker 125 for generating audio output. In one example, the speaker could be in the form of a bone conduction speaker, also referred to as a bone conduction transducer (BCT). Speaker 125 may be, for example, a vibration transducer or an electroacoustic transducer that produces sound in response to an electrical audio signal input. The frame of HMD 102 may be designed such that when a user wears HMD 102, the speaker 125 contacts the wearer. Alternatively, speaker 125 may be embedded within the frame of HMD 102 and positioned such that, when the HMD 102 is worn, speaker 125 vibrates a portion of the frame that contacts the wearer. In either case, HMD 102 may be configured to send an audio signal to speaker 125, so that vibration of the speaker may be directly or indirectly transferred to the bone structure of the wearer. When the vibrations travel through the bone structure to the bones in the middle ear of the wearer, the wearer can interpret the vibrations provided by BCT 125 as sounds.

Various types of bone-conduction transducers (BCTs) may be implemented, depending upon the particular implementation. Generally, any component that is arranged to vibrate the HMD 102 may be incorporated as a vibration transducer. Yet further it should be understood that an HMD 102 may include a single speaker 125 or multiple speakers. In addition, the location(s) of speaker(s) on the HMD may vary, depending upon the implementation. For example, a speaker may be located proximate to a wearer's temple (as shown), behind the wearer's ear, proximate to the wearer's nose, and/or at any other location where the speaker 125 can vibrate the wearer's bone structure.

Figure 1B:
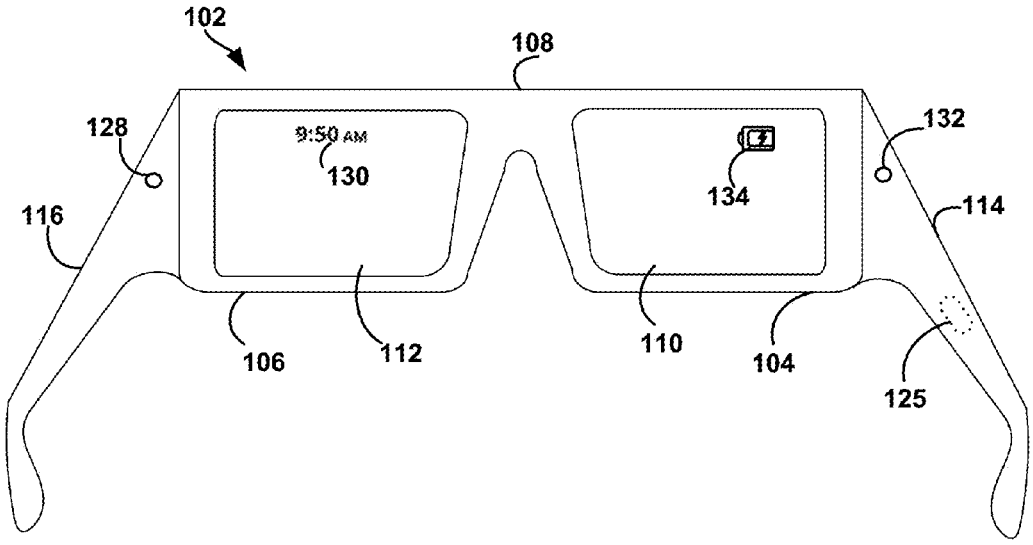
FIG. 1B illustrates an alternate view of the wearable computing device illustrated in FIG. 1A.

FIG. 1B illustrates an alternate view of the wearable computing device illustrated in FIG. 1A. As shown in FIG. 1B, the lens elements 110, 112 may act as display elements. The HMD 102 may include a first projector 128 coupled to an inside surface of the extending side-arm 116 and configured to project a display 130 onto an inside surface of the lens element 112. Additionally or alternatively, a second projector 132 may be coupled to an inside surface of the extending side-arm 114 and configured to project a display 134 onto an inside surface of the lens element 110.

The lens elements 110, 112 may act as a combiner in a light projection system and may include a coating that reflects the light projected onto them from the projectors 128, 132. In some embodiments, a reflective coating may not be used (e.g., when the projectors 128, 132 are scanning laser devices).

In alternative embodiments, other types of display elements may also be used. For example, the lens elements 110, 112 themselves may include: a transparent or semi-transparent matrix display, such as an electroluminescent display or a liquid crystal display, one or more waveguides for delivering an image to the user's eyes, or other optical elements capable of delivering an in focus near-to-eye image to the user. A corresponding display driver may be disposed within the frame elements 104, 106 for driving such a matrix display. Alternatively or additionally, a laser or LED source and scanning system could be used to draw a raster display directly onto the retina of one or more of the user's eyes. Other possibilities exist as well.

Figure 1C:
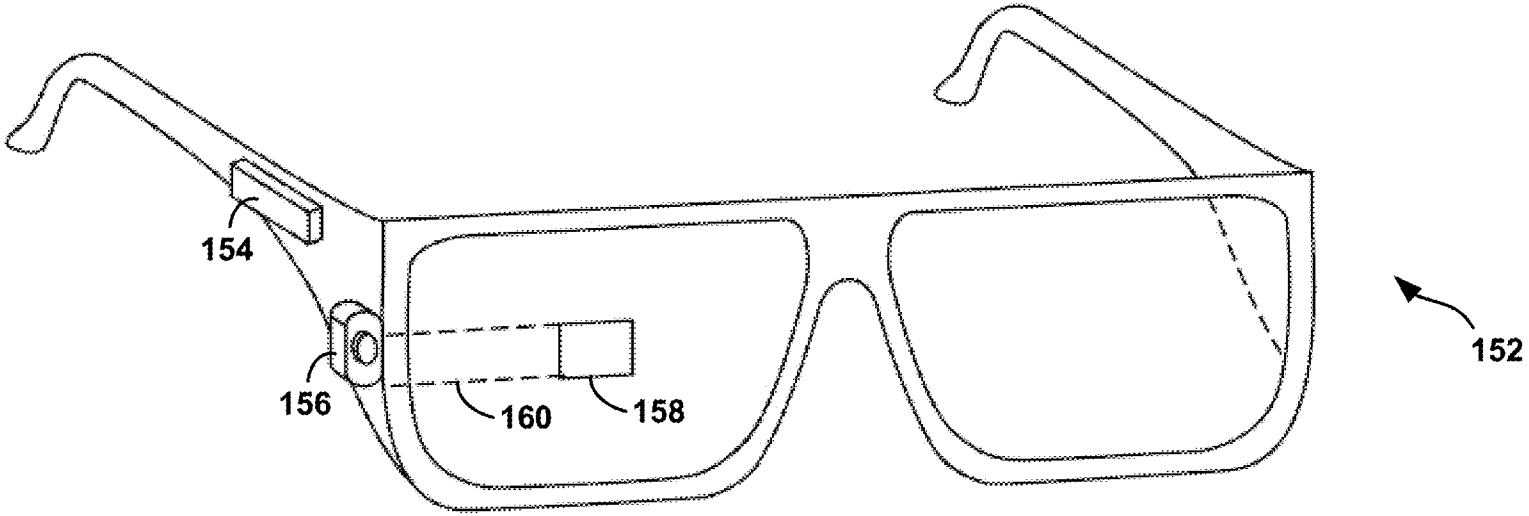
FIG. 1C illustrates another wearable computing system according to an example embodiment.

FIG. 1C illustrates another wearable computing system according to an example embodiment, which takes the form of an HMD 152. The HMD 152 may include frame elements and side-arms such as those described with respect to FIGS. 1A and 1B. The HMD 152 may additionally include an on-board computing system 154 and an image capture device 156, such as those described with respect to FIGS. 1A and 1B. The image capture device 156 is shown mounted on a frame of the HMD 152. However, the image capture device 156 may be mounted at other positions as well, or may be embedded into or otherwise attached to the frame.

As shown in FIG. 1C, the HMD 152 may include a single display 158 which may be coupled to the device. The display 158 may be formed on one of the lens elements of the HMD 152, such as a lens element described with respect to FIGS. 1A and 1B, and may be configured to overlay computer-generated graphics in the user's view of the physical world. The display 158 is shown to be provided in a center of a lens of the HMD 152, however, the display 158 may be provided in other positions, such as for example towards either the upper or lower portions of the wearer's field of view. The display 158 is controllable via the computing system 154 that is coupled to the display 158 via an optical waveguide 160.

Figure 1D:
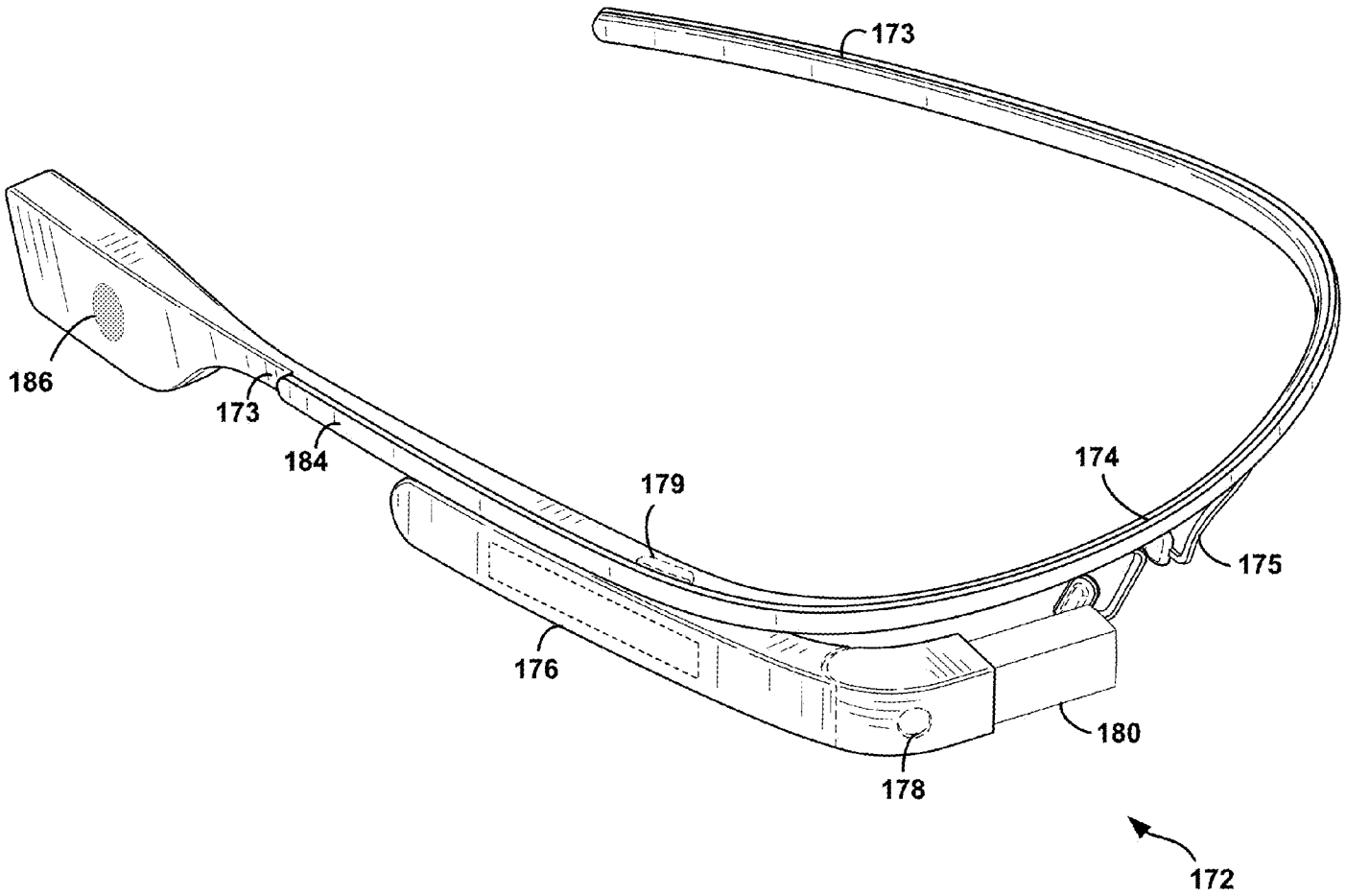
FIG. 1D illustrates another wearable computing system according to an example embodiment.

FIG. 1D illustrates another wearable computing system according to an example embodiment, which takes the form of a monocular HMD 172. The HMD 172 may include side-arms 173, a center frame support 174, and a bridge portion with nosepiece 175. In the example shown in FIG. 1D, the center frame support 174 connects the side-arms 173. The HMD 172 does not include lens-frames containing lens elements. The HMD 172 may additionally include a component housing 176, which may include an on-board computing system (not shown), an image capture device 178, and a button 179 for operating the image capture device 178 (and/or usable for other purposes). Component housing 176 may also include other electrical components and/or may be electrically connected to electrical components at other locations within or on the HMD. HMD 172 also includes a BCT 186.

The HMD 172 may include a single display 180, which may be coupled to one of the side-arms 173 via the component housing 176. In an example embodiment, the display 180 may be a see-through display, which is made of glass and/or another transparent or translucent material, such that the wearer can see their environment through the display 180. Further, the component housing 176 may include the light sources (not shown) for the display 180 and/or optical elements (not shown) to direct light from the light sources to the display 180. As such, display 180 may include optical features that direct light that is generated by such light sources towards the wearer's eye, when HMD 172 is being worn.

In a further aspect, HMD 172 may include a sliding feature 184, which may be used to adjust the length of the side-arms 173. Thus, sliding feature 184 may be used to adjust the fit of HMD 172. Further, an HMD may include other features that allow a wearer to adjust the fit of the HMD, without departing from the scope of the invention.

Figure 1E:
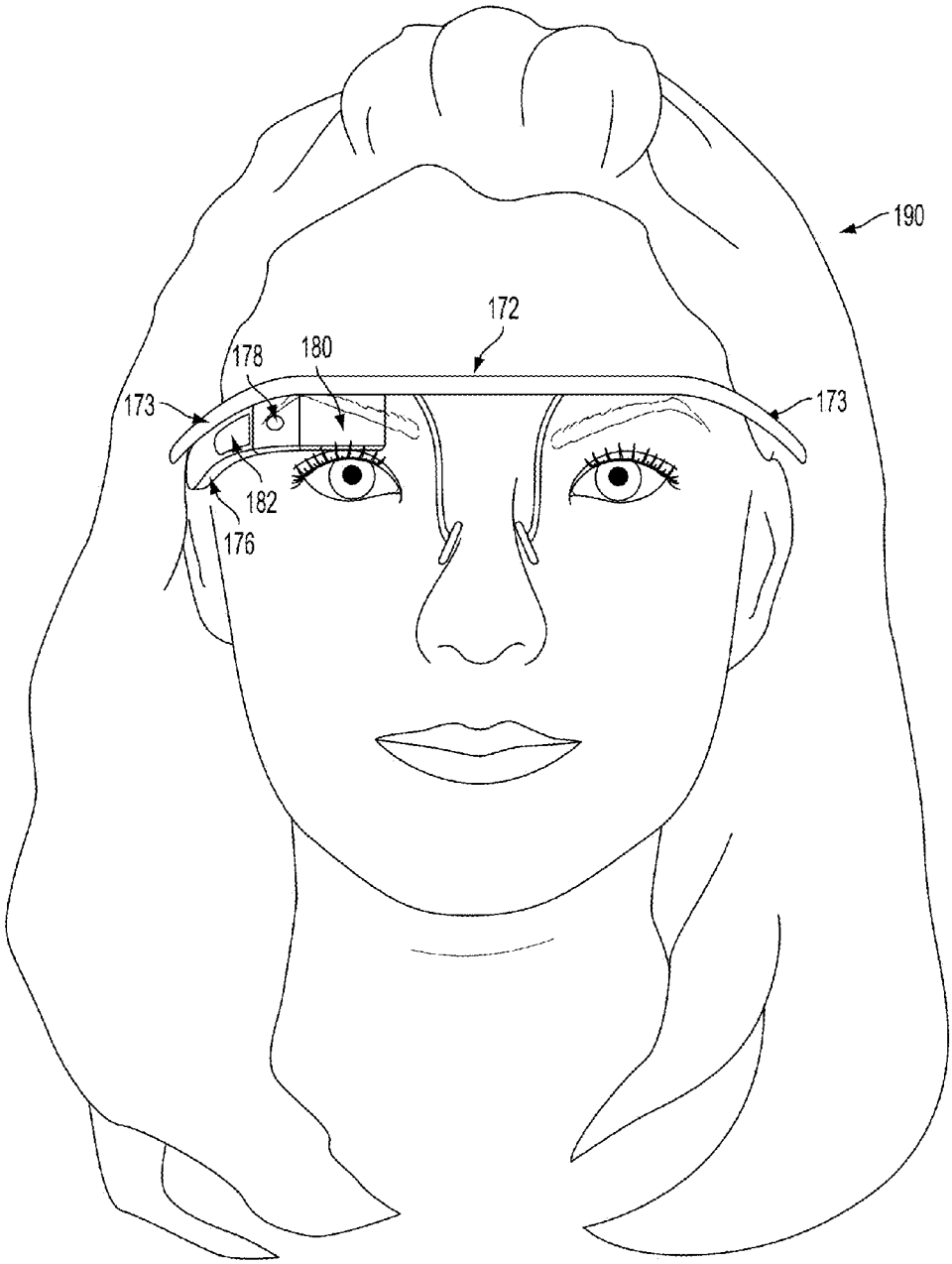
FIGS. 1E to 1G are simplified illustrations of the wearable computing system shown in FIG. 1D, being worn by a wearer.
Figure 1F:
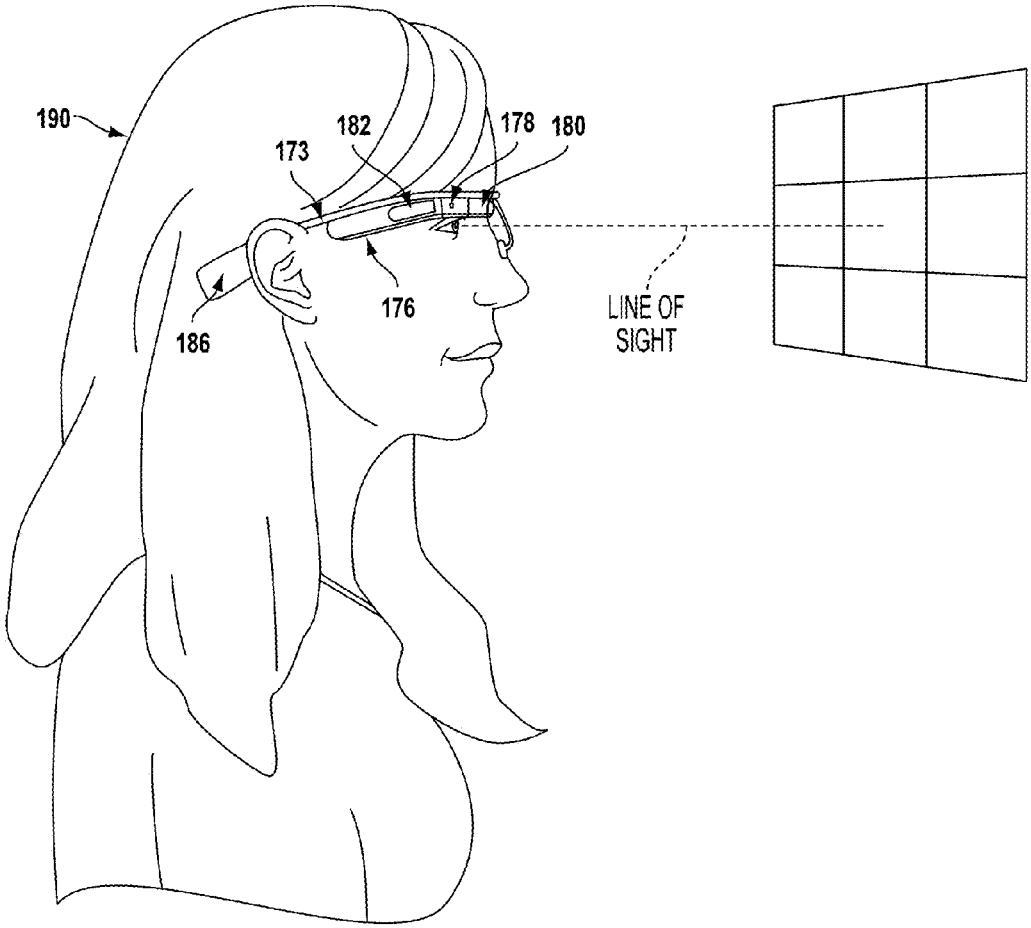
Figure 1G:
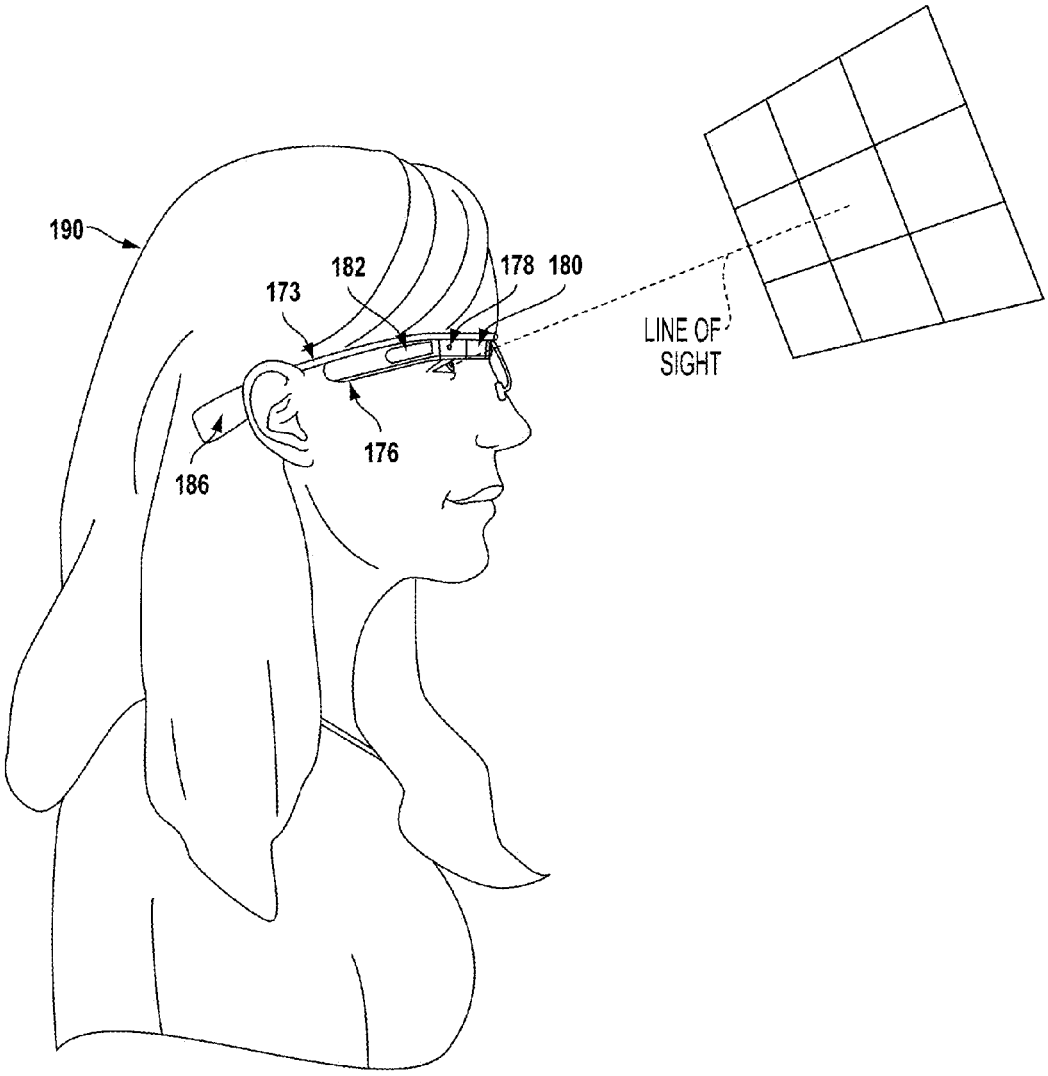

FIGS. 1E to 1G are simplified illustrations of the HMD 172 shown in FIG. 1D, being worn by a wearer 190. As shown in FIG. 1F, when HMD 172 is worn, BCT 186 is arranged such that when HMD 172 is worn, BCT 186 is located behind the wearer's ear. As such, BCT 186 is not visible from the perspective shown in FIG. 1E.

In the illustrated example, the display 180 may be arranged such that when HMD 172 is worn, display 180 is positioned in front of or proximate to a user's eye when the HMD 172 is worn by a user. For example, display 180 may be positioned below the center frame support and above the center of the wearer's eye, as shown in FIG. 1E. Further, in the illustrated configuration, display 180 may be offset from the center of the wearer's eye (e.g., so that the center of display 180 is positioned to the right and above of the center of the wearer's eye, from the wearer's perspective).

Configured as shown in FIGS. 1E to 1G, display 180 may be located in the periphery of the field of view of the wearer 190, when HMD 172 is worn. Thus, as shown by FIG. 1F, when the wearer 190 looks forward, the wearer 190 may see the display 180 with their peripheral vision. As a result, display 180 may be outside the central portion of the wearer's field of view when their eye is facing forward, as it commonly is for many day-to-day activities. Such positioning can facilitate unobstructed eye-to-eye conversations with others, as well as generally providing unobstructed viewing and perception of the world within the central portion of the wearer's field of view. Further, when the display 180 is located as shown, the wearer 190 may view the display 180 by, e.g., looking up with their eyes only (possibly without moving their head). This is illustrated as shown in FIG. 1G, where the wearer has moved their eyes to look up and align their line of sight with display 180. A wearer might also use the display by tilting their head down and aligning their eye with the display 180.

Figure 2:
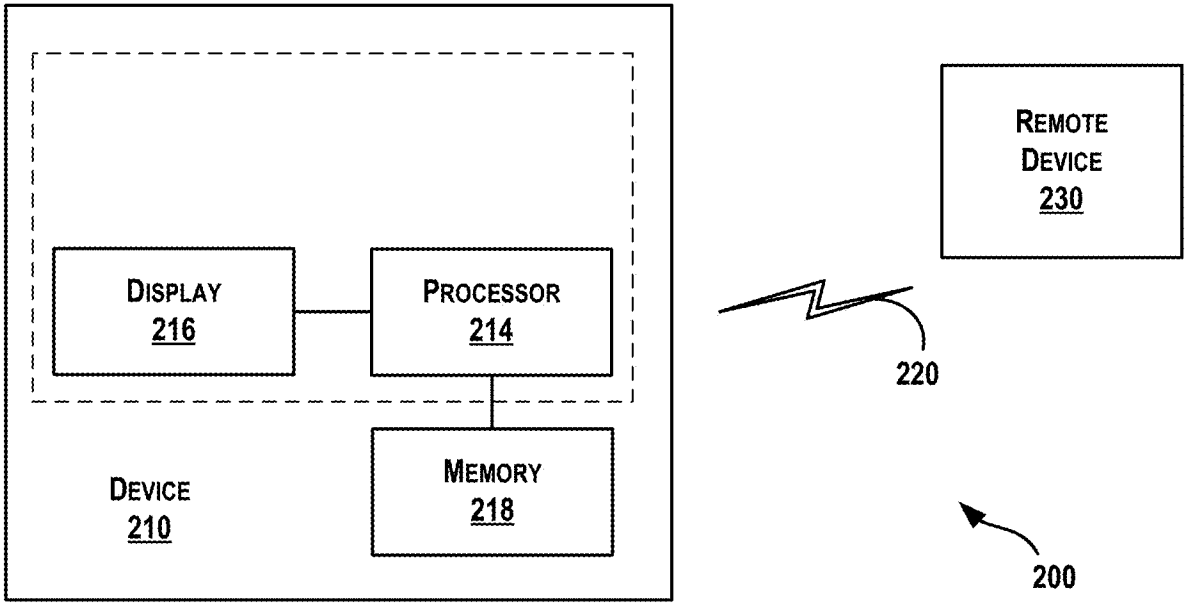
FIG. 2 is a simplified block diagram of a computing device according to an example embodiment.

FIG. 2 is a simplified block diagram a computing device 210 according to an example embodiment. In an example embodiment, device 210 communicates using a communication link 220 (e.g., a wired or wireless connection) to a remote device 230. The device 210 may be any type of device that can receive data and display information corresponding to or associated with the data. For example, the device 210 may take the form of or include a head-mountable display, such as the head-mounted devices 102, 152, or 172 that are described with reference to FIGS. 1A to 1G.

The device 210 may include a processor 214 and a display 216. The display 216 may be, for example, an optical see-through display, an optical see-around display, or a video see-through display. The processor 214 may receive data from the remote device 230, and configure the data for display on the display 216. The processor 214 may be any type of processor, such as a micro-processor or a digital signal processor, for example.

The device 210 may further include on-board data storage, such as memory 218 coupled to the processor 214. The memory 218 may store software that can be accessed and executed by the processor 214, for example.

The remote device 230 may be any type of computing device or transmitter including a laptop computer, a mobile telephone, head-mountable display, tablet computing device, etc., that is configured to transmit data to the device 210. The remote device 230 and the device 210 may contain hardware to enable the communication link 220, such as processors, transmitters, receivers, antennas, etc.

Further, remote device 230 may take the form of or be implemented in a computing system that is in communication with and configured to perform functions on behalf of a client device, such as computing device 210. Such a remote device 230 may receive data from another computing device 210 (e.g., an HMD 102, 152, or 172 or a mobile phone), perform certain processing functions on behalf of the device 210, and then send the resulting data back to device 210. This functionality may be referred to as "cloud" computing.

In FIG. 2, the communication link 220 is illustrated as a wireless connection; however, wired connections may also be used. For example, the communication link 220 may be a wired serial bus such as a universal serial bus or a parallel bus. A wired connection may be a proprietary connection as well. The communication link 220 may also be a wireless connection using, e.g., Bluetooth® radio technology, communication protocols described in IEEE 802.11 (including any IEEE 802.11 revisions), Cellular technology (such as GSM, CDMA, UMTS, EV-DO, WiMAX, or LTE), or Zigbee® technology, among other possibilities. The remote device 230 may be accessible via the Internet and may include a computing cluster associated with a particular web service (e.g., social-networking, photo sharing, address book, etc.).

III. EXAMPLE MICROPHONES

Figure 3:
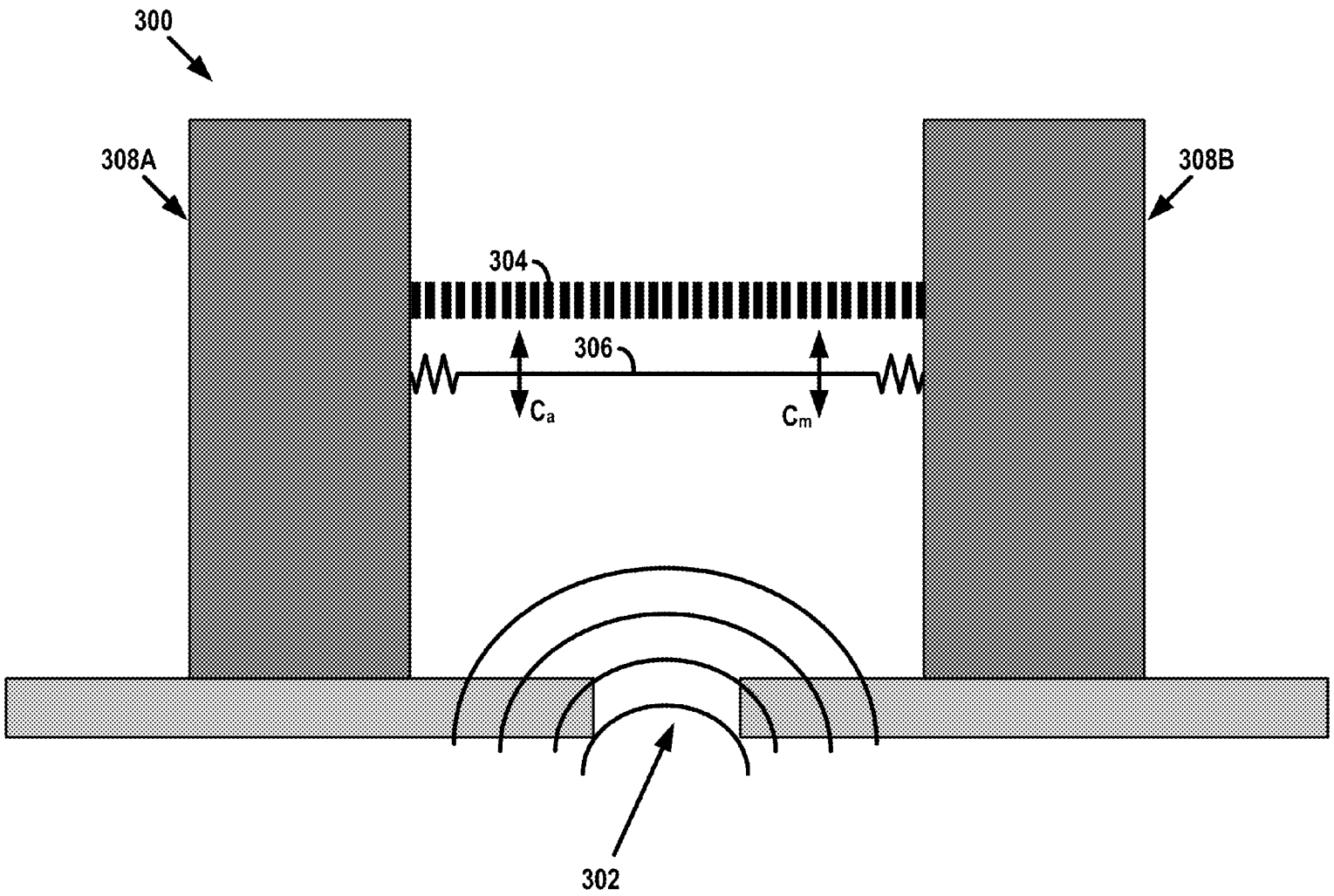
FIG. 3 illustrates a typical microelectromechanical system microphone.

FIG. 3 illustrates a typical MEMS microphone 300. As shown, the microphone 300 includes a backplate 304 and a diaphragm 306. The backplate 304 may be rigid, while the diaphragm 306 may be flexibly mounted to sidewalls 308A,B of the microphone 300. As a result, the backplate 304 may remain substantially stationary during use of the microphone 300, while the diaphragm 306 may vibrate in response to acoustic pressure waves 302 and mechanical vibrations in the microphone 300.

As shown, the microphone 300 is configured to receive the acoustic pressure waves 302 through an opening in the microphone 300. As a result of the acoustic pressure waves 302, the diaphragm 306 may move relative to the backplate 304, resulting in an acoustic capacitance change $\Delta C_a$. However, the microphone 300 may further experience mechanical vibrations that similarly cause the diaphragm 306 to move relative to the backplate 304, resulting in a mechanical capacitance change $\Delta C_m$. Thus, a capacitance change $\Delta C$ of the microphone 300 may reflect both the acoustic and mechanical capacitance changes ($\Delta C_a+\Delta C_m$). For this reason, an audio signal generated based on the capacitance change $\Delta C$ will reflect the acoustic pressure waves 302, but will also include noise as a result of the mechanical vibrations.

The disclosed microphones may allow for reduced noise from mechanical vibrations. To this end, the disclosed microphones may include a first diaphragm and a first backplate, as well as a second diaphragm and a second backplate. Example microphones are described below in connection with FIGS. 4A-D and 5.

Figure 4A:
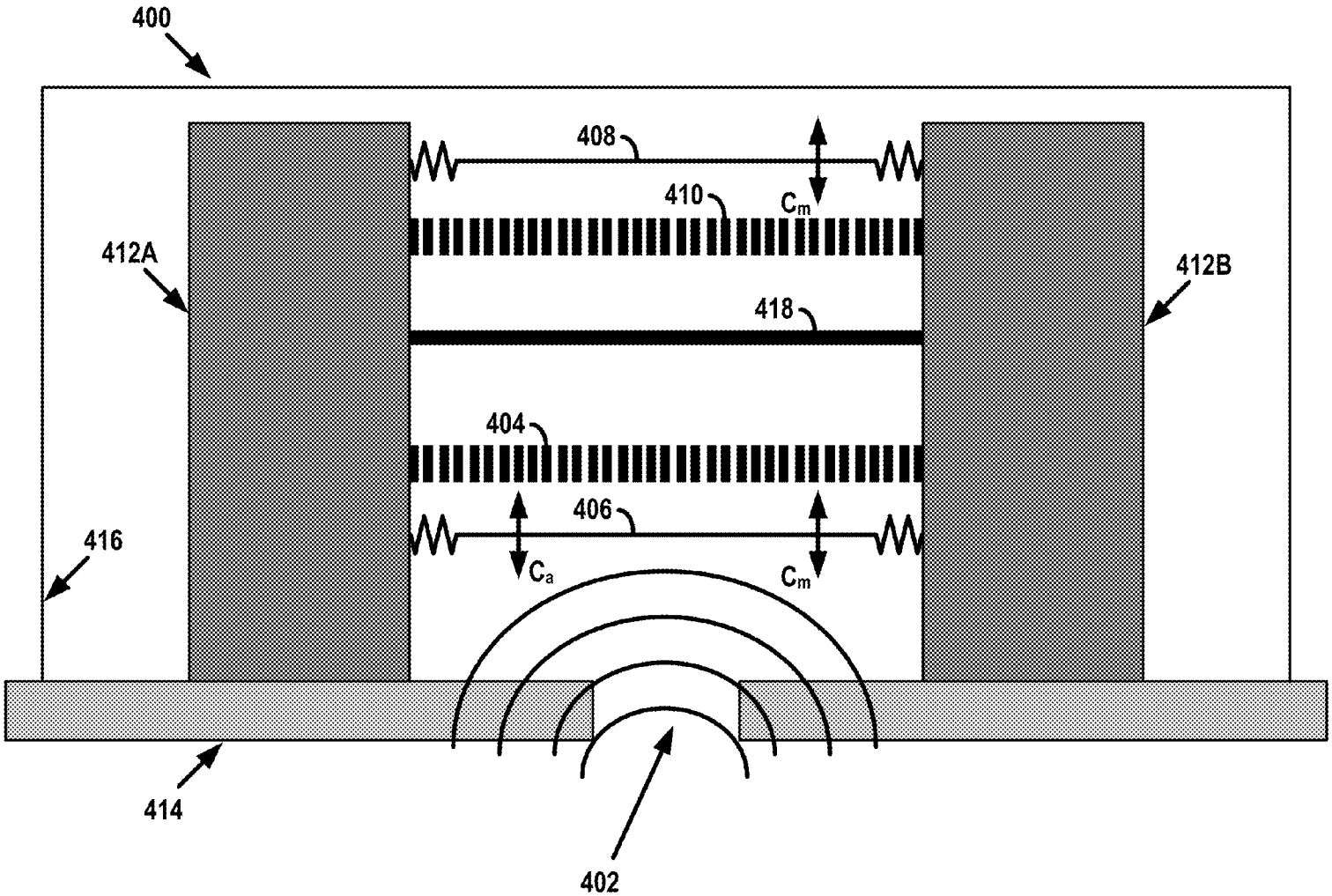
FIGS. 4A to 4D illustrate example microelectromechanical system microphones according to example embodiments.

FIG. 4A illustrates an example MEMS microphone 400 according to an example embodiment. As shown in FIG. 4A, the microphone 400 may include a first backplate 404, a first diaphragm 406, a second diaphragm 408, a second backplate 410, and support structures 412A,B. Each of the first backplate 404, the first diaphragm 406, the second diaphragm 408, the second backplate 410, and the support structures 412A,B may be formed on a substrate 414, such as a silicon substrate, as shown. In other embodiments, the first backplate 404, the first diaphragm 406, the second diaphragm 408, the second backplate 410, and the support structures 412A,B may be formed on one or more additional layers, which may themselves be formed on the substrate 414.

In some embodiments, the microphone 400 may further include a lid 416 formed on the substrate 414 and over the first backplate 404, the first diaphragm 406, the second diaphragm 408, the second backplate 410, and the support structures 412A,B. The lid 416 may serve to substantially enclose the microphone 400 in order to, for example, protect the microphone 400. While the lid 416 is shown to have a rectangular shape, in other embodiments the lid 416 may take any other shape. For example, the lid 416 may take a shape desirable for a particular application of the microphone 400. Other shapes are possible as well. In other embodiments, such as those shown below in FIGS. 4B-D, the microphone 400 may not include a lid 416 at all.

The first pair (i.e., the first diaphragm 406 and the first backplate 404) and the second pair (e.g., the second diaphragm 408 and the second backplate 410) may be physically proximate to one another. For example, the first pair and the second pair may be separated by a distance on the order of millimeters. Other distances are possible as well. In some embodiments, such as that shown in FIG. 4A, a wall 418 may be formed between the first pair and the second pair. The wall 418 may serve to acoustically isolate the second pair from the first pair. In other embodiments, the second pair may be acoustically isolated from the first pair in other ways.

Each of the first backplate 404, the first diaphragm 406, the second diaphragm 408, and the second backplate 410 may be formed from a conductive or semiconductive material, such as silicon. Other materials are possible as well. In general, the first diaphragm 406 and the second diaphragm 408 may have substantially identical compositions, and the first backplate 404 and the second backplate 410 may have substantially identical compositions. In some embodiments, the first diaphragm 406 and the second diaphragm 408 may additionally have other substantially identical parameters, such as a substantially identical mass, suspension stiffness, and/or surface area. Other parameters are possible as well. In general, the first diaphragm 406 and the second diaphragm 408 may be designed to experience substantially identical changes in capacitance in response to mechanical vibrations of the microphone, as described below.

As shown, each of the first backplate 404, the first diaphragm 406, the second diaphragm 408, and the second backplate 410 may be suspended between the support structures 412A, 412B of the microphone 400. The support structures 412A, 412B may similarly be formed of a conductive or semiconductive material, such as silicon. Other materials are possible as well. As shown, the first backplate 404 and the second backplate 410 may be rigidly mounted to the support structures 412A, 412B, while the first diaphragm 406 and the second diaphragm 408 may be flexibly mounted to the support structures 412A, 412B.

The first backplate 404 and the second backplate 410 may each have a thickness great enough to be substantially rigid. The thicknesses of the first backplate 404 and the second backplate 410 may be substantially equal. For example, each of the first backplate 404 and the second backplate 410 may have a thickness on the order of, for instance, 4-5 μm. Other thicknesses are possible as well. As a result, the first backplate 404 and the second backplate 410 may remain substantially stationary during use of the microphone 400. In some embodiments, such as that shown in FIG. 4A, each of the first backplate 404 and the second backplate 410 may be perforated. Perforation may allow for reduced air pressure between the backplates and the diaphragms, thereby allowing for vibration of the diaphragms.

The first diaphragm 406 and the second diaphragm 408 may each be flexibly mounted to the support structures 412A,B. To this end, each of the first diaphragm 406 and the second diaphragm 408 may have edges that are suspended from the support structures 412A,B like springs. The thicknesses of the first diaphragm 406 and the second diaphragm 408 may be substantially equal. For example, each of the first diaphragm 406 and the second diaphragm 408 may have a thickness on the order of, for instance, 1 μm. Other thicknesses are possible as well. As a result, the first diaphragm 406 and the second diaphragm 408 may move relative to the first backplate 404 and the second backplate 410, respectively, during use of the microphone 400.

The first diaphragm 406 may be positioned a first distance from the first backplate 404, and the second diaphragm 408 may be positioned a second distance from the second backplate 410. The first distance and the second distance may be substantially equal. For example, the first distance and the second distance may each be on the order of, for instance, 3 μm. Other first and second distances are possible as well.

The microphone 400 may further include an opening that allows acoustic pressure waves 402 in an environment to couple to the microphone 400. As shown, the first diaphragm 406 may be exposed to the environment through the opening, such that the acoustic pressure waves 402 cause the first diaphragm 406 to move relative first backplate 404. The movement of the first diaphragm 406 relative to the first backplate 404 that results from the acoustic pressure waves 402 may cause an acoustic capacitance change $\Delta C_a$ between the first diaphragm 406 and the first backplate 404.

By contrast, as shown, the second diaphragm 408 may be substantially acoustically isolated from the environment, such that the acoustic pressure waves 402 do not cause the second diaphragm 408 to move relative to the second backplate 410. To this end, the second diaphragm 408 may be acoustically separated from the acoustic pressure waves 402 by, for example, the wall 418 and/or air. Alternatively or additionally, the second diaphragm 408 may include perforations designed to allow the acoustic pressure waves 402 to pass through the second diaphragm 408 without displacing the second diaphragm 408 relative to the second backplate 410. The second diaphragm 408 may be substantially acoustically isolated from the acoustic pressure waves 402 in other manners as well. Accordingly, substantially no acoustic capacitance change may appear between the second diaphragm 408 and the second backplate 410 as a result of the acoustic pressure waves 402.

In addition to the acoustic pressure waves 402, the microphone 400 may be exposed to mechanical vibrations. The mechanical vibrations may result from, for example, movement of the microphone 400. Movement of the microphone 400 may be the result of movement of a wearer of the microphone 400, movement of a device in which the microphone 400 is integrated (e.g., vibration of the device), vibration resulting from audio output of nearby speakers, receivers, or other audio output modules, or other movement. Other sources of the mechanical vibrations are possible as well.

The mechanical vibrations may cause the first diaphragm 406 to further move relative first backplate 404. The movement of the first diaphragm 406 relative to the first backplate 404 that results from the mechanical vibrations may cause a mechanical capacitance change $\Delta C_m$ between the first diaphragm 406 and the first backplate 404. The mechanical vibrations may further cause the second diaphragm 408 to move relative to the second backplate 410. Due to the physical proximity and substantially identical compositions, thicknesses, and other parameters of the first diaphragm 406 and the second diaphragm 408, the second diaphragm 408 may move relative to the second backplate 410 to cause substantially the same mechanical capacitance change $\Delta C_m$ between the second diaphragm 408 and the second backplate 410.

Thus, the movement of the first diaphragm 406 relative to the first backplate 404 that results from the acoustic pressure waves 402 and the mechanical vibrations may cause a first capacitance change $\Delta C_1$ between the first diaphragm 406 and the first backplate 404. The first capacitance change $\Delta C_1$ may reflect both the acoustic capacitance change $\Delta C_a$ and the mechanical capacitance change $\Delta C_m$:

$$\Delta C_1 = \Delta C_a + \Delta C_m.$$

Further, the movement of the second diaphragm 408 relative to the second backplate 410 that results from the mechanical vibrations may cause a second capacitance change $\Delta C_2$ between the second diaphragm 408 and the second backplate 410. The second capacitance change $\Delta C_2$ may reflect substantially only the mechanical capacitance change $\Delta C_m$ (or, at least, may be predominated by and/or approximately equal to the mechanical capacitance change $\Delta C_m$):

$$\Delta C_2 = \Delta C_m.$$

The microphone 400 may include or may be communicatively coupled to an integrated circuit that is configured to generate an audio signal based on the first capacitance change $\Delta C_1$ and the second capacitance change $\Delta C_2$. To this end, the integrated circuit may isolate the acoustic capacitance change $\Delta C_a$ by subtracting the second capacitance change $\Delta C_2$ from the first capacitance change $\Delta C_1$:

$$\Delta C_1 - \Delta C_2$$

$$(\Delta C_a + \Delta C_m) - (\Delta C_m)$$

$$\Delta C_a.$$

The integrated circuit may be further configured to generate the audio signal based on the isolated acoustic capacitance change $\Delta C_a$.

By subtracting the second capacitance change $\Delta C_2$ from the first capacitance change $\Delta C_1$, the integrated circuit may substantially cancel out the mechanical capacitance change $\Delta C_m$. In this manner, the integrated circuit may minimize noise in the audio signal that results from the mechanical vibrations.

While FIG. 4A depicts the first backplate 404 adjacent to the second backplate 410, in other embodiments an order of the first diaphragm 406, the first backplate 404, the second backplate 410, and the second diaphragm 408 may vary.

Figure 4B:
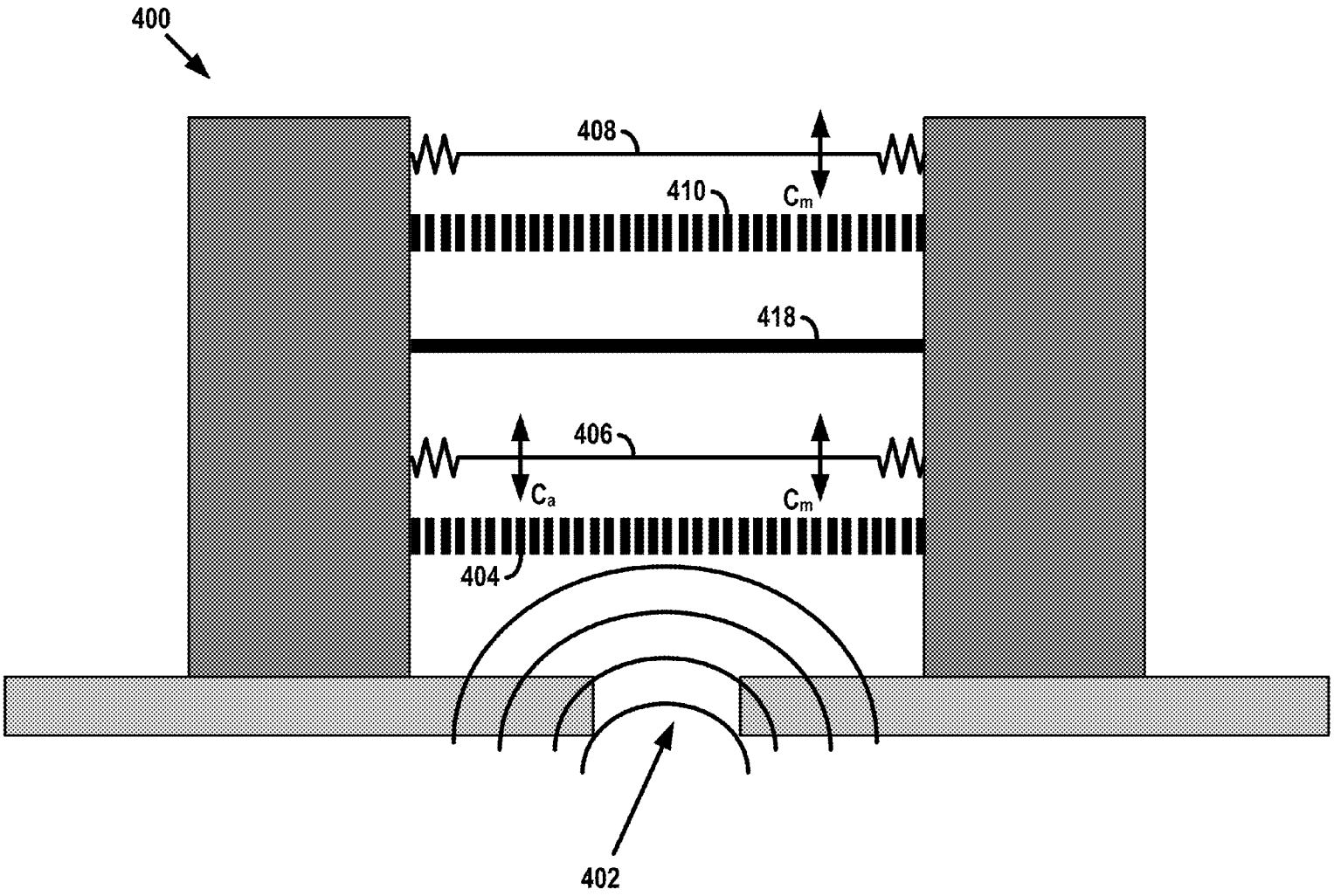

For example, FIG. 4B illustrates another example microphone 400 according to an example embodiment. The microphone 400 shown in FIG. 4B may be substantially identical in form and operation to the microphone 400 described above in connection with FIG. 4A, except that, as shown, the positions of the first diaphragm 406 and the first backplate 404 may be reversed, such that the first diaphragm 406 is adjacent to the second backplate 410.

Figure 4C:
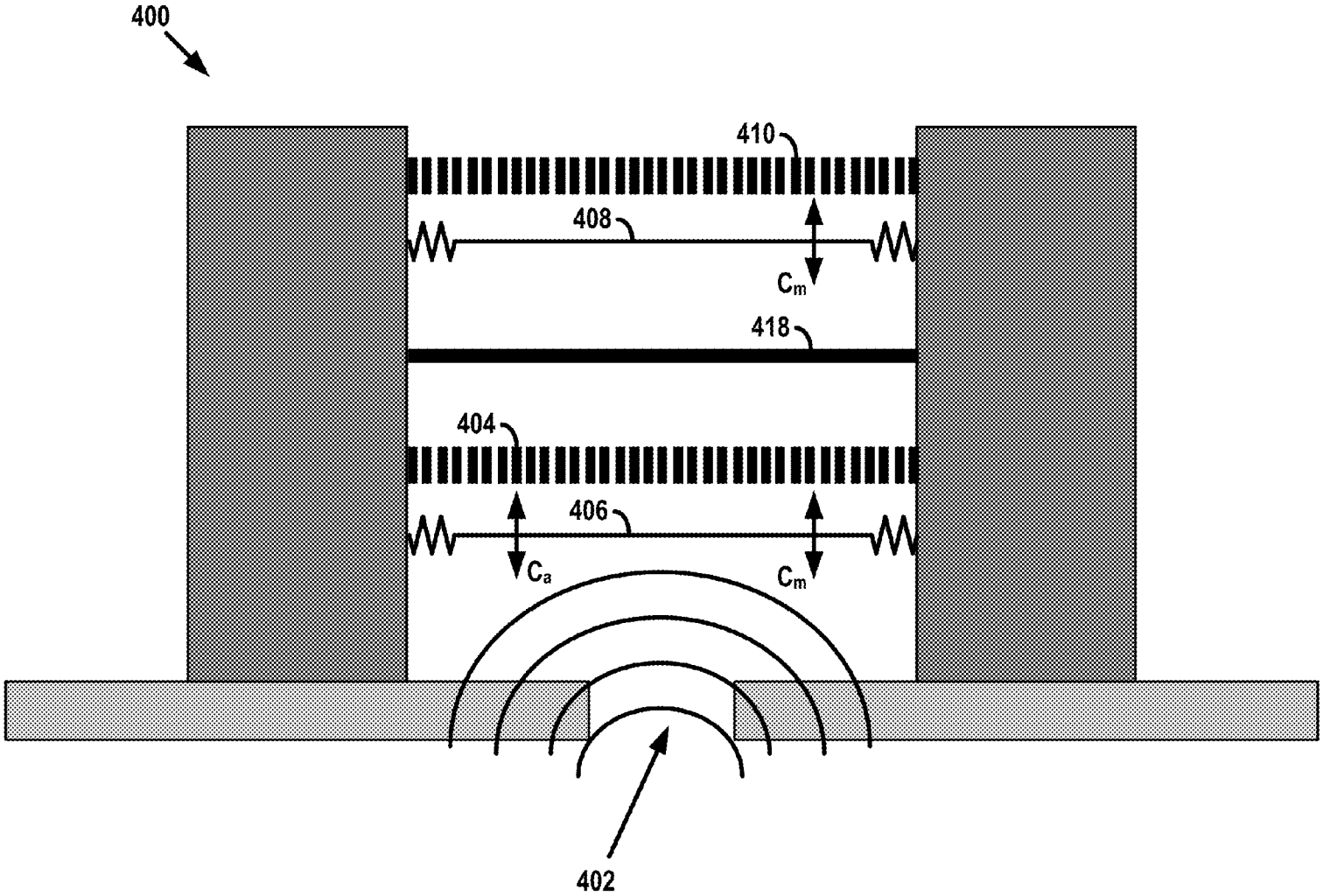

As another example, FIG. 4C illustrates another example microphone 400 according to an example embodiment. The microphone 400 shown in FIG. 4C may be substantially identical in form and operation to the microphone 400 described above in connection with FIG. 4A, except that, as shown, the positions of the second diaphragm 408 and the second backplate 410 may be reversed, such that the first backplate 404 is adjacent to the second diaphragm 408.

Figure 4D:
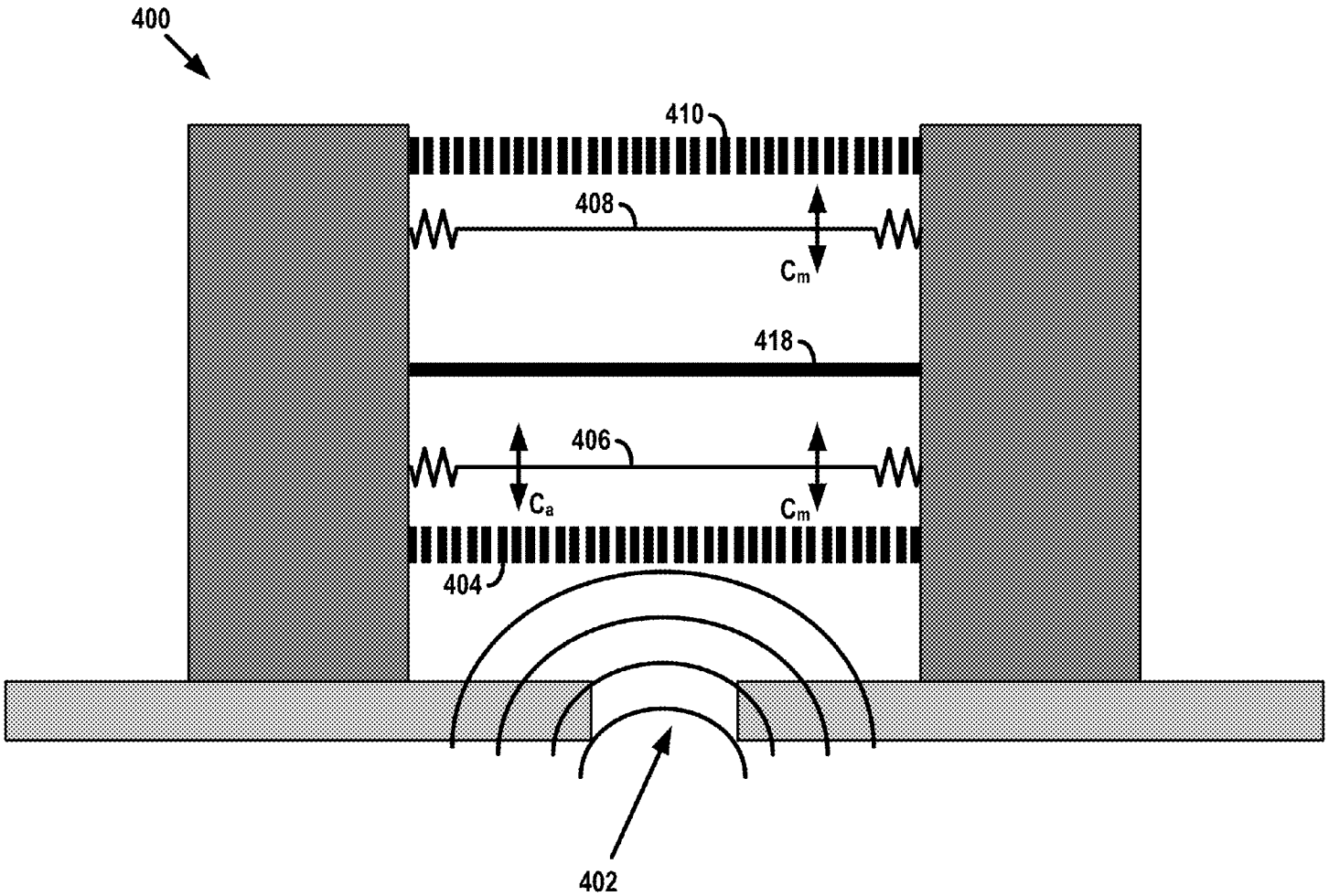

As still another example, FIG. 4D illustrates an example microphone 400 according to an example embodiment. The microphone 400 shown in FIG. 4D may be substantially identical in form and operation to the microphone 400 described above in connection with FIG. 4A, except that, as shown, the positions of the first diaphragm 406 and the first backplate 404 may be reversed, and the positions of the second diaphragm 408 and the second backplate 410 may be reversed, such that the first diaphragm 406 is adjacent to the second diaphragm 408.

While the microphones shown in FIGS. 4B-D are not shown to include a lid 416, as described above in connection with FIG. 4A, it will be understood that in some embodiments microphones may include a lid. Other configurations of the microphone 400 are possible as well.

Figure 5:
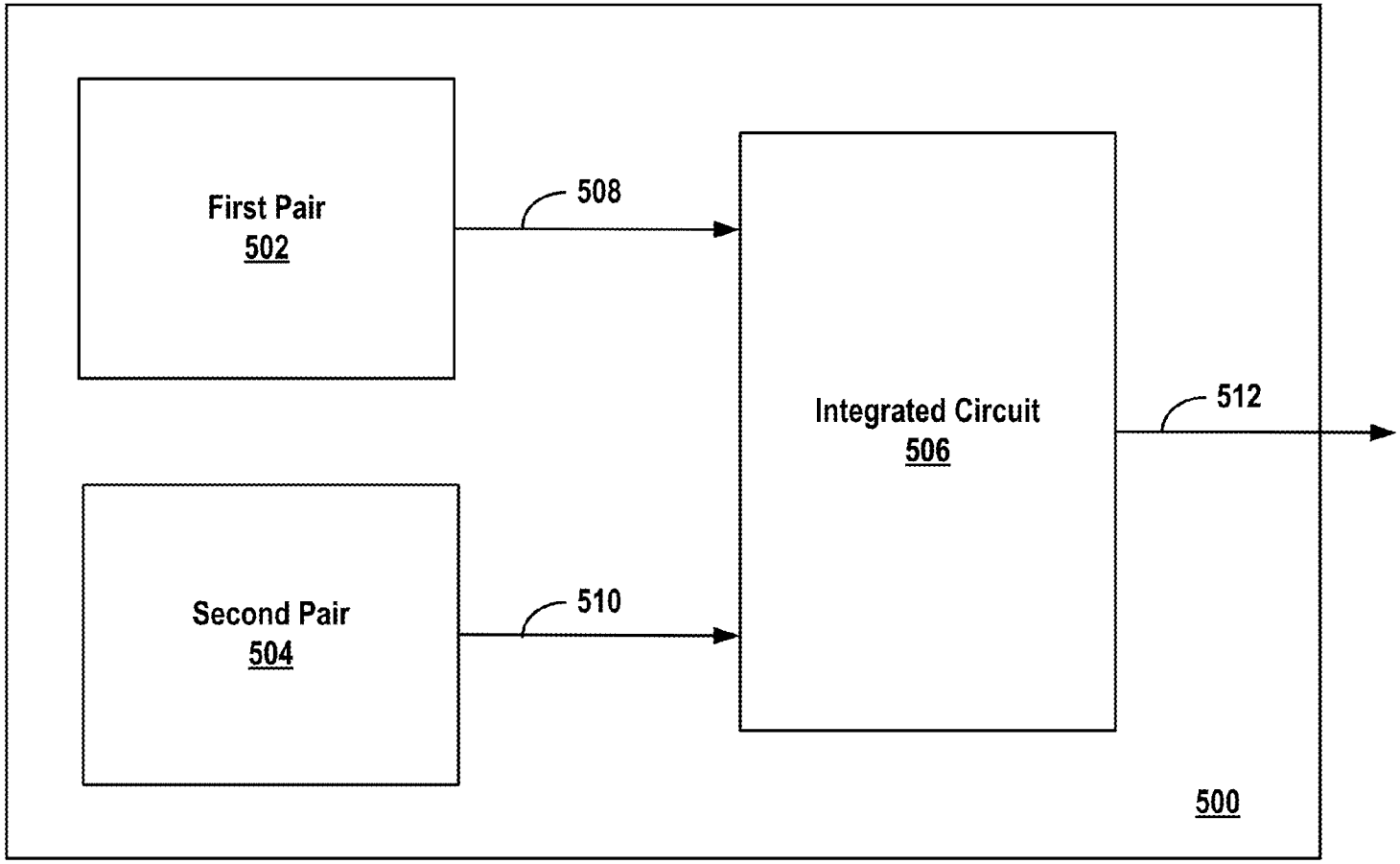
FIG. 5 is a simplified block diagram of a microelectromechanical system microphone according to an example embodiment.

FIG. 5 is a simplified block diagram of a MEMS microphone 500 according to an example embodiment. As shown, the microphone 500 includes a first pair 502, a second pair 504, and an integrated circuit 506.

The first pair 502 may include a first diaphragm and a first backplate, such as the first diaphragm 406 and the first backplate 404 described above in connection with FIGS. 4A-D. The first diaphragm may be exposed to an environment that includes acoustic pressure waves, and may be further exposed to mechanical vibrations. As a result of the acoustic pressure waves and the mechanical vibrations, the first diaphragm may move relative to the first backplate, causing a first capacitance change 508 to appear between the first diaphragm and the first backplate, as described above.

Similarly, the second pair 504 may include a second diaphragm and a second backplate, such as the second diaphragm 408 and the second backplate 410 described above in connection with FIGS. 4A-D. The second diaphragm may be substantially acoustically isolated from the environment that includes acoustic pressure waves, but the second diaphragm may be exposed to the mechanical vibrations. As a result of the mechanical vibrations, the second diaphragm may move relative to the second backplate, causing a second capacitance change 510 to appear between the second diaphragm and the second backplate, as described above.

The first pair 502 may be configured to provide the first capacitance change 508 to the integrated circuit 506, as shown. To this end, the first pair 502 may be communicatively coupled to the integrated circuit 506 via, for example, wire bonding.

Similarly, the second pair 504 may be configured to provide the second capacitance change 510 to the integrated circuit 506, as shown. To this end, the second pair 504 may be communicatively coupled to the integrated circuit 506 via, for example, wire bonding.

The integrated circuit 506 may be configured to generate an audio signal 512 based on the first capacitance change 508 and the second capacitance change 510, as described above. To this end, the integrated circuit 506 may convert the first capacitance change 508 into a first voltage signal. Because the first capacitance change 508 is caused by movement of the first diaphragm relative to the first backplate caused by both the acoustic pressure waves and the mechanical vibrations, the first voltage signal may be based on both the acoustic pressure waves and the mechanical vibrations. The integrated circuit 506 may further convert the second capacitance change 510 into a second voltage signal. Because the second capacitance change 510 is caused by movement of the second diaphragm relative to the second backplate caused substantially only by the mechanical vibrations, the second voltage signal may be based on substantially only the mechanical vibrations.

The integrated circuit 506 may further subtract the second voltage signal from the first voltage signal to generate an acoustic signal. By subtracting the second capacitance change 510 from the first capacitance change 508, the integrated circuit 506 may substantially cancel out capacitance change resulting from the mechanical vibrations, as described above. In this manner, the integrated circuit 506 may minimize noise in the audio signal 512 that results from the mechanical vibrations.

In some embodiments, the integrated circuit 506 may be configured to further process the audio signal 512 by, for example, tuning and/or adjusting a gain of the audio signal 512. Other processing is possible as well.

The integrated circuit 506 may be further configured to output the audio signal 512. The integrated circuit 506 may output the audio signal 512 to, for example, a speaker or another component of a device in which the microphone 500 is integrated (or with which the microphone 500 may be implemented). To this end, the integrated circuit 506 may be communicatively coupled to the speaker or other component via a wired and/or wireless connection. The integrated circuit 506 may output the audio signal 512 in other manners as well.

While the integrated circuit 506 is shown to be integrated in the microphone 500, in other embodiments the integrated circuit 506 may be distinct from and communicatively coupled to the microphone 500. For example, in embodiments where the microphone 500 is integrated with a device (such as, for example, a wearable computing device), the integrated circuit 506 may be a distinct component in the device. The integrated circuit 506 may take other forms as well.

In some embodiments, in addition to being configured to generate the audio signal 512, the integrated circuit 506 may be configured to additionally generate an audio signal that includes the mechanical-vibration-induced noise (e.g., by generating the audio signal based only on the first capacitance change 508). Alternatively or additionally, the integrated circuit 506 may be configured to function as an accelerometer (e.g., by generating an accelerometer signal based only on the second capacitance change 510). The integrated circuit 506 may be configured for other functions as well.

IV. EXAMPLE METHODS

Figure 6:
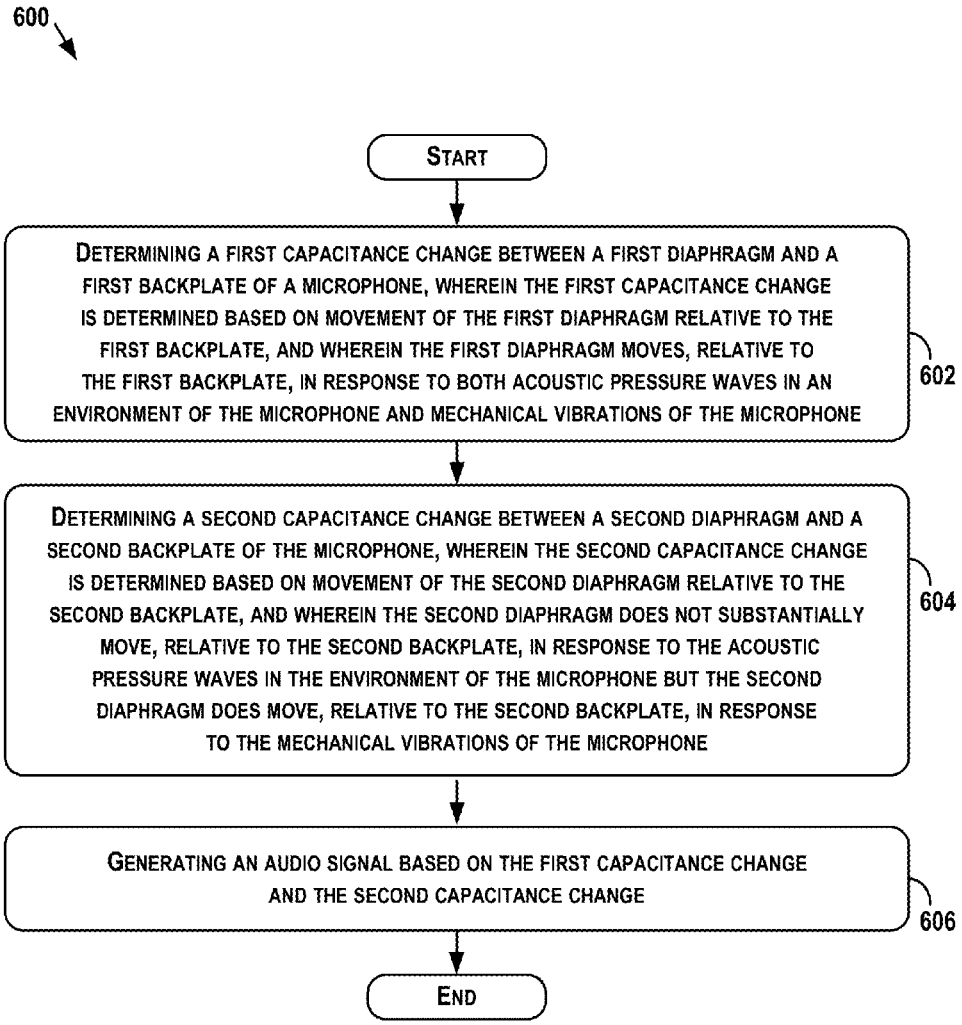
FIG. 6 is a flow chart illustrating a method according to an example embodiment.

FIG. 6 is a block diagram of a method 600 according to an example embodiment. Method 600 presents an embodiment of a method that, for example, could be used with the microphones described herein, such as the microphones 400, 500 described above in connection with FIGS. 4A-D and 5, respectively. Alternatively or additionally the method could, for example, be used with systems described herein, such as the wearable computing systems 102, 152, 172 and wearable computing device 210 described above in connection with FIGS. 1A-G, and 2, respectively.

The blocks 602-606 of the method 600 may be performed by a single system or by multiple systems. For example, all of the blocks 602-606 may be performed by a microphone, such as the microphone 400 described above in connection with FIGS. 4A-D. As another example, one or more of blocks 602-606 may be performed by a microphone, such as the microphone 400 described above in connection with FIGS. 4A-D, while others of blocks 602-606 may be performed by a wearable computing system, such as the wearable computing systems 102, 152, 172 and wearable computing device 210 described above in connection with FIGS. 1A-G, and 2, respectively. Other examples are possible as well.

Method 600 may include one or more operations, functions, or actions as illustrated by one or more of blocks 602-606. Although the blocks are illustrated in a sequential order, these blocks may also be performed in parallel, and/or in a different order than those described herein. Also, the various blocks may be combined into fewer blocks, divided into additional blocks, and/or removed based upon the desired implementation.

In addition, for the method 600 and other processes and methods disclosed herein, the flowchart shows functionality and operation of one possible implementation of present embodiments. In this regard, each block may represent a module, a segment, or a portion of program code, which includes one or more instructions executable by a processor for implementing specific logical functions or steps in the process. The program code may be stored on any type of computer-readable medium, such as, for example, a storage device including a disk or hard drive. The computer-readable medium may include a non-transitory computer-readable medium, for example, such as computer-readable media that store data for short periods of time like register memory, processor cache, and Random Access Memory (RAM). The computer-readable medium may also include non-transitory media, such as secondary or persistent long term storage, like read only memory (ROM), optical or magnetic disks, and compact-disc read only memory (CD-ROM), for example. The computer-readable media may also be any other volatile or non-volatile storage systems. The computer-readable medium may be considered a computer-readable storage medium, a tangible storage device, or other article of manufacture, for example.

In addition, for the method 600 and other processes and methods disclosed herein, each block may represent circuitry that is configured to perform the specific logical functions in the process.

As shown, the method 600 may begin at block 602 determining a first capacitance change between a first diaphragm and a first backplate of a microphone. The microphone may take the form of, for example, any of microphones 400 and 500 described above in connection with FIGS. 4A-D and 5, respectively. The first capacitance change may be determined based on movement of the first diaphragm relative to the first backplate. The first diaphragm may move relative to the first backplate in response to both acoustic pressure waves in an environment of the microphone and mechanical vibrations of the microphone. In particular, the movement of the first diaphragm relative to the first backplate that results from the acoustic pressure waves may result in an acoustic capacitance change $\Delta C_a$ between the first diaphragm and the first backplate, as described above. The movement of the first diaphragm relative to the first backplate that results from the mechanical vibrations of the microphone may result in a mechanical capacitance change $\Delta C_m$ between the first diaphragm and the first backplate, as described above. The first capacitance change may be given by a sum of the acoustic capacitance change $\Delta C_a$ and the mechanical capacitance change $\Delta C_m$:

$$\Delta C_1 = \Delta C_a + \Delta C_m.$$

The method 600 continues at block 604 with determining a second capacitance change between a second diaphragm and a second backplate of the microphone. The second capacitance may be determined based on movement of the second diaphragm relative to the second backplate. The second diaphragm may be substantially acoustically isolated from the acoustic pressure waves, such that the second diaphragm does not substantially move relative to the second backplate in response to the acoustic pressure waves in the environment of the microphone. However, the second diaphragm may move relative to the second backplate in response to the mechanical vibrations of the microphone. The movement of the second diaphragm relative to the second backplate that results from the mechanical vibrations of the microphone may result in a mechanical capacitance change $\Delta C_m$ between second first diaphragm and the second backplate, as described above. The second capacitance change may be given by the mechanical capacitance change $\Delta C_m$:

$$\Delta C_2 = \Delta C_m.$$

The method 600 continues at block 606 with generating an audio signal based on a difference between the first capacitance change $\Delta C_1$ and the second capacitance change $\Delta C_2$. By determining the difference between the first capacitance change $\Delta C_1$ and the second capacitance change $\Delta C_2$, the mechanical capacitance change $\Delta C_m$ may be cancelled out and the acoustic capacitance change $\Delta C_a$ may be isolated:

$$\Delta C_1 - \Delta C_2$$

$$(\Delta C_a + \Delta C_m) - (\Delta C_m)$$

$$\Delta C_a.$$

The audio signal may then be generated based on the isolated acoustic capacitance change $\Delta C_a$. In this manner, the integrated circuit may minimize noise in the audio signal that results from the mechanical vibrations.

While the foregoing described processing the first and second capacitance changes $\Delta C_{1,2}$ themselves, in some embodiments the first and second capacitance changes $\Delta C_{1,2}$ may be converted to voltages before being processed. In particular, the first capacitance change $\Delta C_1$ may be converted to a first voltage signal $V_1$. Like the first capacitance change $\Delta C_1$, the first voltage signal $V_1$ may be based on both the acoustic pressure waves and the mechanical vibrations:

$$V_1 = V_a + V_m,$$

where $V_a$ is an acoustic voltage that corresponds to the acoustic capacitance change $\Delta C_a$, and $V_m$ is a mechanical voltage that corresponds to the mechanical voltage change $\Delta C_m$.

Further, the second capacitance change $\Delta C_2$ may be converted to a second voltage signal $V_2$. Like the second capacitance change $\Delta C_2$, the second voltage signal $V_2$ may be based substantially only on the mechanical vibrations:

$$V_2 - V_m.$$

Once converted, the second voltage signal $V_2$ may be subtracted from the first voltage signal $V_1$. By subtracting the second voltage signal $V_2$ may be subtracted from the first voltage signal $V_1$, the mechanical voltage $V_m$ may be cancelled out and the acoustic voltage $V_a$ may be isolated:

$$V_1 - V_2$$

$$(V_a + V_m) - (V_m)$$

$$V_a.$$

The audio signal may then be generated based on the isolated acoustic voltage $V_a$. In this manner, the integrated circuit may minimize noise in the audio signal that results from the mechanical vibrations.

The realities of modern devices and the methods of their production are not absolutes, but rather statistical efforts to produce a desired device and/or result. Even with the utmost of attention being paid to repeatability of processes, operation of manufacturing facilities, the nature of starting and processing materials, and so forth, variations and imperfections result. Accordingly, no limitation in the description of the present disclosure or its claims can or should be read as absolute. To further highlight this, the term "substantially" may occasionally be used herein. While as difficult to precisely define as the limitations of the present disclosure themselves, we intend that this term be interpreted as "to a large extent", "as nearly as practicable", "within technical limitations", and the like.

V. CONCLUSION

In the figures, similar symbols typically identify similar components, unless context indicates otherwise. The illustrative embodiments described in the detailed description, figures, and claims are not meant to be limiting. Other embodiments can be utilized, and other changes can be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

With respect to any or all of the message flow diagrams, scenarios, and flow charts in the figures and as discussed herein, each step, block and/or communication may represent a processing of information and/or a transmission of information in accordance with example embodiments. Alternative embodiments are included within the scope of these example embodiments. In these alternative embodiments, for example, functions described as steps, blocks, transmissions, communications, requests, responses, and/or messages may be executed out of order from that shown or discussed, including in substantially concurrent or in reverse order, depending on the functionality involved. Further, more or fewer steps, blocks and/or functions may be used with any of the message flow diagrams, scenarios, and flow charts discussed herein, and these message flow diagrams, scenarios, and flow charts may be combined with one another, in part or in whole.

A step or block that represents a processing of information may correspond to circuitry that can be configured to perform the specific logical functions of a herein-described method or technique. Alternatively or additionally, a step or block that represents a processing of information may correspond to a module, a segment, or a portion of program code (including related data). The program code may include one or more instructions executable by a processor for implementing specific logical functions or actions in the method or technique. The program code and/or related data may be stored on any type of computer-readable medium, such as a storage device, including a disk drive, a hard drive, or other storage media.

The computer-readable medium may also include non-transitory computer-readable media such as computer-readable media that stores data for short periods of time like register memory, processor cache, and/or random access memory (RAM). The computer-readable media may also include non-transitory computer-readable media that stores program code and/or data for longer periods of time, such as secondary or persistent long term storage, like read only memory (ROM), optical or magnetic disks, and/or compact-disc read only memory (CD-ROM), for example. The computer-readable media may also be any other volatile or non-volatile storage systems. A computer-readable medium may be considered a computer-readable storage medium, for example, or a tangible storage device.

Moreover, a step or block that represents one or more information transmissions may correspond to information transmissions between software and/or hardware modules in the same physical device. However, other information transmissions may be between software modules and/or hardware modules in different physical devices.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, a user's identity may be treated so that no personally identifiable information can be determined for the user, or a user's geographic location may be generalized where location information is obtained (such as to a city, ZIP code, or state level), so that a particular location of a user cannot be determined. Thus, the user may haw control over how information is collected about the user and used by a content server.

We claim:

1. An apparatus comprising:

a microphone; and an integrated circuit, wherein the microphone comprises a first diaphragm arranged such that: (i) the first diaphragm moves, relative to a first backplate, in response to acoustic pressure waves in an environment of the microphone, and (ii) the first diaphragm also moves, relative to the first backplate, in response to mechanical vibrations of the microphone, wherein movement of the first diaphragm relative to the first backplate causes a first capacitance change between the first diaphragm and the first backplate;

wherein the microphone further comprises a second diaphragm that is substantially acoustically isolated from the environment of the microphone such that the second diaphragm does not move substantially, relative to a second backplate, in response to the acoustic pressure waves in the environment, wherein the second diaphragm moves, relative to the second backplate, in response to the mechanical vibrations of the microphone, and wherein movement of the second diaphragm relative to the second backplate causes a second capacitance change between the second diaphragm and the second backplate; and wherein the integrated circuit is configured to generate an audio signal based on a difference between the first capacitance change and the second capacitance change.

2. The apparatus of claim 1, wherein:

the first capacitance change comprises (i) an acoustic capacitance change based on the movement of the first diaphragm relative to the first backplate in response to the acoustic pressure waves and (ii) a first mechanical capacitance change based on the movement of the first diaphragm relative to the first backplate in response to the mechanical vibrations;

the second capacitance change comprises a second mechanical capacitance change based on the movement of the second diaphragm relative to the second backplate in response to the mechanical vibrations; and the first mechanical capacitance change is substantially equal to the second mechanical capacitance change.

3. The apparatus of claim 1, wherein the integrated circuit being configured to generate the audio signal based on the difference between the first capacitance change and the second capacitance change comprises the integrated circuit being configured to:

convert the first capacitance change into a first voltage signal, wherein the first voltage signal is based on both the acoustic pressure waves and the mechanical vibrations;

convert the second capacitance change into a second voltage signal, wherein the second voltage signal is based on the mechanical vibrations; and subtract the second voltage signal from the first voltage signal to generate an acoustic signal.

4. The apparatus of claim 1, wherein each of the first diaphragm and the second diaphragm comprises silicon.

5. The apparatus of claim 1, wherein each of the first backplate and the second backplate comprises silicon.

6. The apparatus of claim 1, further comprising support structures, wherein each of the first diaphragm and the second diaphragm are flexibly mounted to the support structures.

7. The apparatus of claim 6, wherein the support structures comprise silicon.

8. The apparatus of claim 1, further comprising a substrate, wherein:

at least the first backplate, the first diaphragm, the second backplate, and the second diaphragm are formed on the substrate; and the substrate comprises an opening configured to receive the acoustic pressure waves.

9. The apparatus of claim 8, further comprising a lid formed (i) on the substrate and (ii) over at least the first backplate, the first diaphragm, the second backplate, and the second diaphragm.

10. A microphone comprising:

a first diaphragm that is arranged such that: (i) the first diaphragm moves, relative to a first backplate, in response to acoustic pressure waves in an environment of the microphone, and (ii) the first diaphragm also moves, relative to the first backplate, in response to mechanical vibrations of the microphone, wherein movement of the first diaphragm relative to the first backplate causes a first capacitance change between the first diaphragm and the first backplate; and a second diaphragm that is substantially acoustically isolated from the environment of the microphone such that the second diaphragm does not move substantially, relative to a second backplate, in response to the acoustic pressure waves in the environment, wherein the second diaphragm moves, relative to the second backplate, in response to the mechanical vibrations of the microphone, and wherein movement of the second diaphragm relative to the second backplate causes a second capacitance change between the second diaphragm and the second backplate.

11. The microphone of claim 10, wherein each of the first diaphragm and the second diaphragm comprises silicon.

12. The microphone of claim 10, wherein each of the first rigid backplate and the second rigid backplate comprises silicon.

13. The microphone of claim 10, further comprising support structures, wherein each of the first diaphragm and the second diaphragm are flexibly mounted to the support structures.

14. The microphone of claim 13, wherein the support structures comprise silicon.

15. The microphone of claim 10, wherein the first diaphragm is adjacent to the second rigid backplate.

16. The microphone of claim 10, wherein the first rigid backplate is adjacent to the second rigid backplate.

17. The microphone of claim 10, wherein the first flexible diaphragm is adjacent to the second flexible diaphragm.

18. The microphone of claim 10, wherein the first rigid backplate is adjacent to the second flexible diaphragm.

19. A method comprising:

determining a first capacitance change between a first diaphragm and a first backplate of a microphone, wherein the first capacitance change is determined based on movement of the first diaphragm relative to the first backplate, and wherein the first diaphragm moves, relative to the first backplate, in response to both acoustic pressure waves in an environment of the microphone and mechanical vibration of the microphone;

determining a second capacitance change between a second diaphragm and a second backplate of the microphone, wherein the second capacitance change is determined based on movement of the second diaphragm relative to the second backplate, and wherein the second diaphragm does not substantially move, relative to the second backplate, in response to the acoustic pressure waves in the environment of the microphone but the second diaphragm does move, relative to the second backplate, in response to the mechanical vibration of the microphone; and generating an audio signal based on a difference between the first capacitance change and the second capacitance change.

20. The method of claim 19, wherein generating the audio signal based on the difference between the first capacitance change and the second capacitance change comprises:

converting the first capacitance change into a first voltage signal, wherein the first voltage signal is based on both the acoustic pressure waves and the mechanical vibrations;

converting the second capacitance change into a second voltage signal, wherein the second voltage signal is based on the mechanical vibrations; and subtracting the second voltage signal from the first voltage signal to generate an acoustic signal.

* * * * *